US011187239B2

(12) United States Patent
Tadokoro et al.

(10) Patent No.: US 11,187,239 B2
(45) Date of Patent: Nov. 30, 2021

(54) PROPELLER FAN, AIR-SENDING DEVICE, AND REFRIGERATION CYCLE APPARATUS

(71) Applicant: Mitsubishi Electric Corporation, Tokyo (JP)

(72) Inventors: Takahide Tadokoro, Tokyo (JP); Takuya Teramoto, Tokyo (JP); Katsuyuki Yamamoto, Tokyo (JP); Hiroya Ito, Tokyo (JP); Yuki Ugajin, Tokyo (JP); Shingo Hamada, Tokyo (JP); Takashi Ikeda, Tokyo (JP); Takafumi Abe, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 53 days.

(21) Appl. No.: 16/620,650

(22) PCT Filed: Aug. 9, 2017

(86) PCT No.: PCT/JP2017/028957
§ 371 (c)(1),
(2) Date: Dec. 9, 2019

(87) PCT Pub. No.: WO2019/030866
PCT Pub. Date: Feb. 14, 2019

(65) Prior Publication Data
US 2021/0003142 A1 Jan. 7, 2021

(51) Int. Cl.
*F04D 29/38* (2006.01)
*F25D 17/06* (2006.01)

(52) U.S. Cl.
CPC ..... *F04D 29/384* (2013.01); *F25D 17/067* (2013.01); *F05D 2240/303* (2013.01); *F05D 2240/304* (2013.01); *F25D 2317/0681* (2013.01)

(58) Field of Classification Search
CPC ..... F04D 29/384; F25D 17/067; F25D 2317/0681; F05D 2240/303; F05D 2240/304
See application file for complete search history.

(56) References Cited

U.S. PATENT DOCUMENTS

2011/0120168 A1* 5/2011 Choi ..... F25B 7/00 62/324.6
2015/0345513 A1* 12/2015 Tadokoro ..... F04D 25/02 165/121

(Continued)

FOREIGN PATENT DOCUMENTS

AU 6530680 A 8/1981
CN 105102822 A 11/2015

(Continued)

OTHER PUBLICATIONS

International Search Report of the International Searching Authority dated Nov. 7, 2017 for the corresponding International application No. PCT/JP2017/028957 (and English translation).

(Continued)

*Primary Examiner* — Jacob M Amick
*Assistant Examiner* — Charles J Brauch
(74) *Attorney, Agent, or Firm* — Posz Law Group, PLC

(57) ABSTRACT

A propeller fan according to an embodiment of the present invention includes a shaft provided a rotation axis of the propeller fan, and a blade provided on an outer peripheral side of the shaft. The blade has a trailing edge on a rear side of the blade in a rotation direction of the propeller fan. The trailing edge includes a first trailing edge located on an innermost side of the trailing edge, and a second trailing edge adjacent to and outward of the first trailing edge. Where an innermost point of the first trailing edge is a first connection point, a connection point between the first trailing edge and the second trailing edge is a second connection (Continued)

point, and a straight line that extends through the rotation axis and the first connection point is a reference line, the second connection point is located forward of the reference line in the rotation direction, or located on the reference line, and the second trailing edge is located rearward of the second connection point in the rotation direction.

8 Claims, 20 Drawing Sheets

(56) References Cited

U.S. PATENT DOCUMENTS

| | | | |
|---|---|---|---|
| 2016/0025101 | A1 | 1/2016 | Tadokoro et al. |
| 2018/0003190 | A1 | 1/2018 | Hamada et al. |
| 2019/0048890 | A1 | 2/2019 | Honma et al. |

FOREIGN PATENT DOCUMENTS

| | | | | |
|---|---|---|---|---|
| DE | 102004059988 | A1 * | 6/2006 | ..... F04D 25/082 |
| JP | S55-025666 | U | 2/1980 | |
| JP | H08-049697 | A | 2/1996 | |
| JP | 2010-255560 | A | 11/2010 | |
| JP | 2015-190332 | A | 11/2015 | |
| JP | 2016-166000 | A | 9/2016 | |
| WO | 2014/103702 | A1 | 7/2014 | |
| WO | 2014/162758 | A1 | 10/2014 | |
| WO | 2016/021555 | A1 | 2/2016 | |
| WO | 2017/154246 | A1 | 9/2017 | |

OTHER PUBLICATIONS

Extended European Search Report dated Jul. 17, 2020 issued in corresponding EP application No. 17920624.8.

Office Action dated Aug. 4, 2020 issued in corresponding CN patent application No. 201780093633.3 ( and English translation).

Examination Report dated Jan. 7, 2021 issued corresponding AU patent application No. 2017427464.

Examination Report dated Mar. 15, 2021 issued corresponding IN patent application No. 202047002308.

Examination Report dated Sep. 25, 2020 issued corresponding AU patent application No. 2017427464.

* cited by examiner

Comparative Example

Comparative Example

Comparative Example

Comparative Example

PROPELLER FAN, AIR-SENDING DEVICE, AND REFRIGERATION CYCLE APPARATUS

CROSS REFERENCE TO RELATED APPLICATION

This application is a U.S. national stage application of PCT/JP2017/028957 filed on Aug. 9, 2017, the contents of which are incorporated herein by reference.

TECHNICAL FIELD

The present invention relates to a propeller fan that includes blades, and an air-sending device and a refrigeration cycle apparatus that include the propeller fan.

BACKGROUND ART

In the past, some blade shapes of propeller fans have been proposed as shapes for achieving low noise and a high efficiency of air-sending devices. The noise and energy loss of air-sending devices are made by the turbulence of airflow, for example, vortexes. For example, a fan motor that drives a propeller fan and is provided on an upstream side and an inner peripheral side of the propeller fan disturbs airflow toward a blade at the propeller fan. As a result, on an inner peripheral side of the blade, the airflow does not move along the blade and is easily disturbed, and vortexes are easily generated.

In view of this, blade shapes for reducing the turbulence of the airflow and generation of vortexes have been proposed. For example, Patent Literature 1 discloses that an inner part of a trailing edge of a blade is cut, and a protrusion portion that protrudes in the opposite direction to a rotation direction of the blade is provided at the trailing edge to increase the area of the blade and to increase a static pressure to a higher level.

CITATION LIST

Patent Literature

Patent Literature 1: Japanese Unexamined Patent Application Publication No. 2015-190332

SUMMARY OF INVENTION

Technical Problem

In the propeller fan disclosed in Patent Literature 1, the inner peripheral side of the trailing edge of the blade extends along the flow direction of blown air, and the axis of vortexes generated at the trailing is parallel to the flow direction of airflow that passes over a blade surface. Therefore, vortexes developed over the blade surface from a leading edge join vortexes generated at the trailing edge, and remain until the air flows on a downstream side after being blown.

The present invention has been made to solve the above problem and provides a propeller fan in which the strength of vortexes generated at a trailing edge of a blade can be reduced, an air-sending device provided with the propeller fan, and a refrigeration cycle apparatus provided with the propeller fan.

Solution to Problem

A propeller fan according to an embodiment of the present invention includes a shaft provided on a rotation axis of the propeller fan, and a blade provided on an outer peripheral side of the shaft. The blade has a trailing edge on a rear side of the blade in a rotation direction of the propeller fan. The trailing edge includes a first trailing edge located on an innermost side of the trailing edge, and a second trailing edge adjacent to and outward of the first trailing edge. Where an innermost point of the first trailing edge is a first connection point, a connection point between the first trailing edge and the second trailing edge is a second connection point, and a straight line that extends through the rotation axis and the first connection point is a reference line, the second connection point is located forward of the reference line in the rotation direction, or located on the reference line, and the second trailing edge is located rearward of the second connection point in the rotation direction.

Advantageous Effects of Invention

In the propeller fan according to the embodiment of the present invention, the second connection point is located forward of the reference line in the rotation direction, or located on the reference line, and the second trailing edge is located rearward of the second connection point in the rotation direction. Thus, vortexes generated at the first trailing edge and vortexes generated at the second trailing edge weaken each other. It is therefore possible to reduce the strength of the vortexes generated at the trailing edge of each blade.

DESCRIPTION OF EMBODIMENTS

Figure 1:
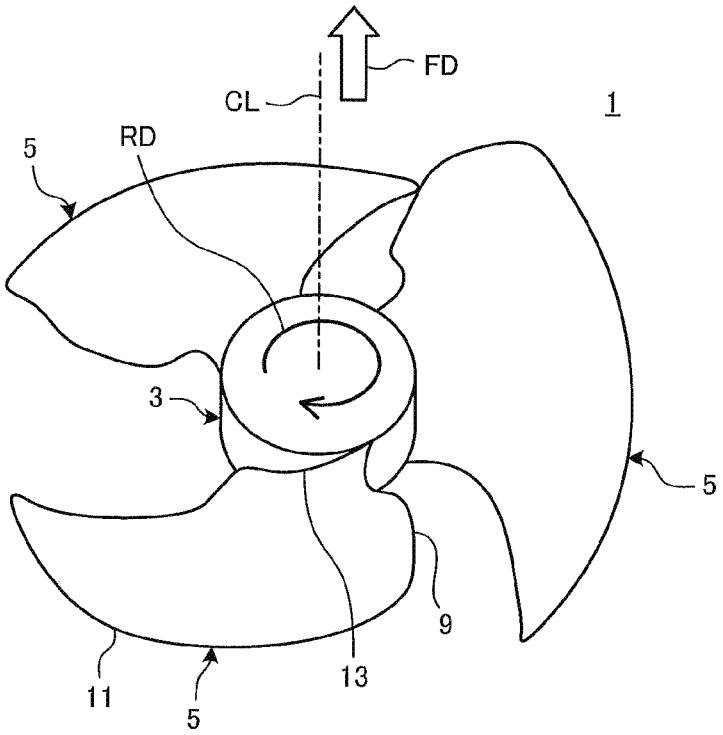
FIG. 1 schematically illustrates a perspective view of a configuration of a propeller fan according to Embodiment 1.

Propeller fans according to Embodiment 1 to Embodiment 6 of the present invention will hereinafter be described with reference to the drawings. In the drawings, like reference signs designate like or corresponding components.

Embodiment 1

Overall Configuration

FIG. 1 schematically illustrates a perspective view of the configuration of a propeller fan according to Embodiment 1.

Figure 2:
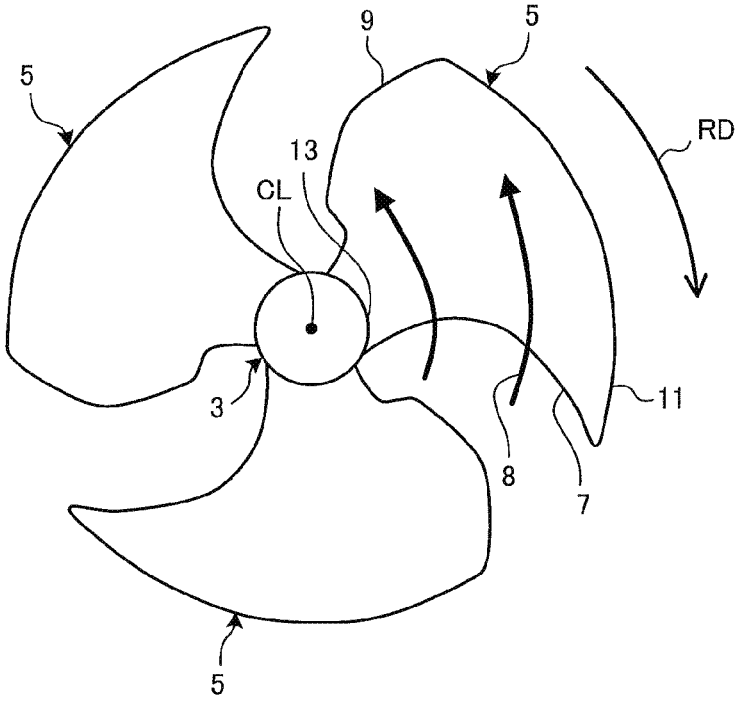
FIG. 2 illustrates a shape obtained by projecting the propeller fan according to Embodiment 1 on a plane perpendicular to a rotation axis.

FIG. 2 illustrates a shape of the propeller fan according to Embodiment 1 that is projected on a plane perpendicular to a rotation axis of the propeller fan. The shape as illustrated in FIG. 2 is that as seen from surfaces of blades 5 that are made to push airflow, that is, pressure surfaces of the blades 5.

As illustrated in FIGS. 1 and 2, a propeller fan 1 includes a boss 3 that is provided along a rotation axis CL and the blades 5 that are disposed at an outer peripheral side of the boss 3. The boss 3 is rotated around the rotation axis CL. The blades 5 radially extend from the boss 3 and extends outwards in a radial direction thereof. The blades 5 are equiangularly spaced from each other in a circumferential direction.

The boss 3 corresponds to "shaft" in the present invention.

In the figures, an arrow RD indicates a rotation direction RD of the propeller fan 1, and an arrow FD indicates a flow direction FD of airflow. In Embodiment 1, the number of the blades 5 is three, but it is not limited to three.

Each of the blades 5 includes a leading edge 7, a trailing edge 9, an outer peripheral edge 11, and an inner peripheral edge 13. The leading edge 7 is formed as a front edge in the rotation direction RD. That is, the leading edge 7 is located on a front side of each blade 5 in the rotation direction RD. The trailing edge 9 is formed as a rear edge in the rotation direction RD. That is, the trailing edge 9 is located on a rear side of each blade 5 in the rotation direction RD. The inner peripheral edge 13 arcuately extends between innermost part of the leading edge 7 and innermost part of the trailing edge 9. Each blade 5 is connected to the outer peripheral side of the boss 3 at the inner peripheral edge 13. The outer peripheral edge 11 arcuately extends to connect outermost part of the leading edge 7 and outermost part of the trailing edge 9. For example, the radius of a circle whose center is located on the rotation axis CL and which passes through the outer peripheral edge 11 is constant. In the figures, arrows 8 indicate flows of air that flows to the pressure surface of each blade 5 when the propeller fan 1 is rotated.

With respect to Embodiment 1, it is described by way of example that the radius of the circle that passes through the outer peripheral edge 11 is constant. However, the shape of the outer peripheral edge 11 is not limited to such a shape. The shape of the outer peripheral edge 11 can be freely determined.

Configuration of Trailing Edge 9

The configuration of the trailing edge 9 will now be described in detail.

Figure 3:
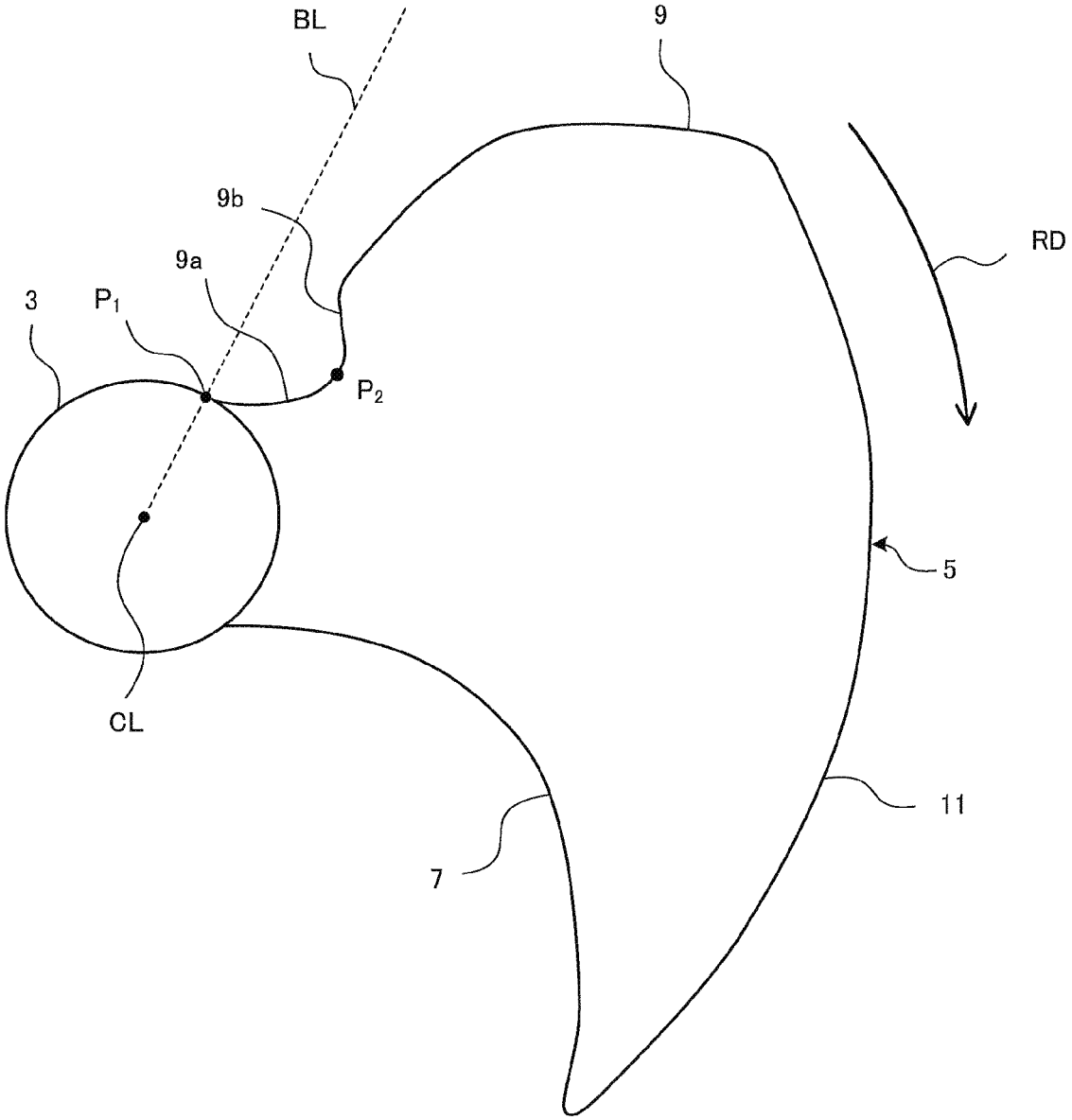
FIG. 3 illustrates the shape of a blade of the propeller fan according to Embodiment 1.

FIG. 3 is an explanatory view illustrating the shape of one of the blades of the propeller fan according to Embodiment 1. The shape as illustrated FIG. 3 is the shape of the propeller fan 1 that is projected on the plane perpendicular to the rotation axis CL. In FIG. 3, only one of the blades 5 is illustrated.

As illustrated in FIG. 3, the trailing edge 9 of each blade 5 includes a first trailing edge 9*a* adjacent to the boss 3 and a second trailing edge 9*b* adjacent to the first trailing edge 9*a*. That is, the first trailing edge 9*a* is the innermost part of the trailing edge 9. The second trailing edge 9*b* is part of the trailing edge 9 that is adjacent to the first trailing edge 9*a* and located outward of the first trailing edge 9*a*.

A connection point between the boss 3 and the first trailing edge 9*a* will be referred to as a first connection point P1. That is, the first connection point P1 is an innermost point of the first trailing edge 9*a*. A connection point between the first trailing edge 9*a* and the second trailing edge 9*b* will be referred to a second connection point P2. A straight line that extends through the rotation axis CL and the first connection point P1 will be referred to as a reference line BL.

The trailing edge 9 of each blade 5 is formed such that the second connection point P2 is located forward of the reference line BL in the rotation direction RD. Also, in the formed trailing edge 9, the second trailing edge 9*b* is located rearward of the second connection point P2 in the rotation direction RD. Furthermore, in the formed training edge 9, the first trailing edge 9*a* is located forward of the reference line BL in the rotation direction RD. That is, the first trailing edge 9*a* extends forward from the first connection point P1 to the second connection point P2 in the rotation direction RD. The second trailing edge 9*b* extends rearward from the second connection point P2 in the rotation direction RD.

Figure 4:
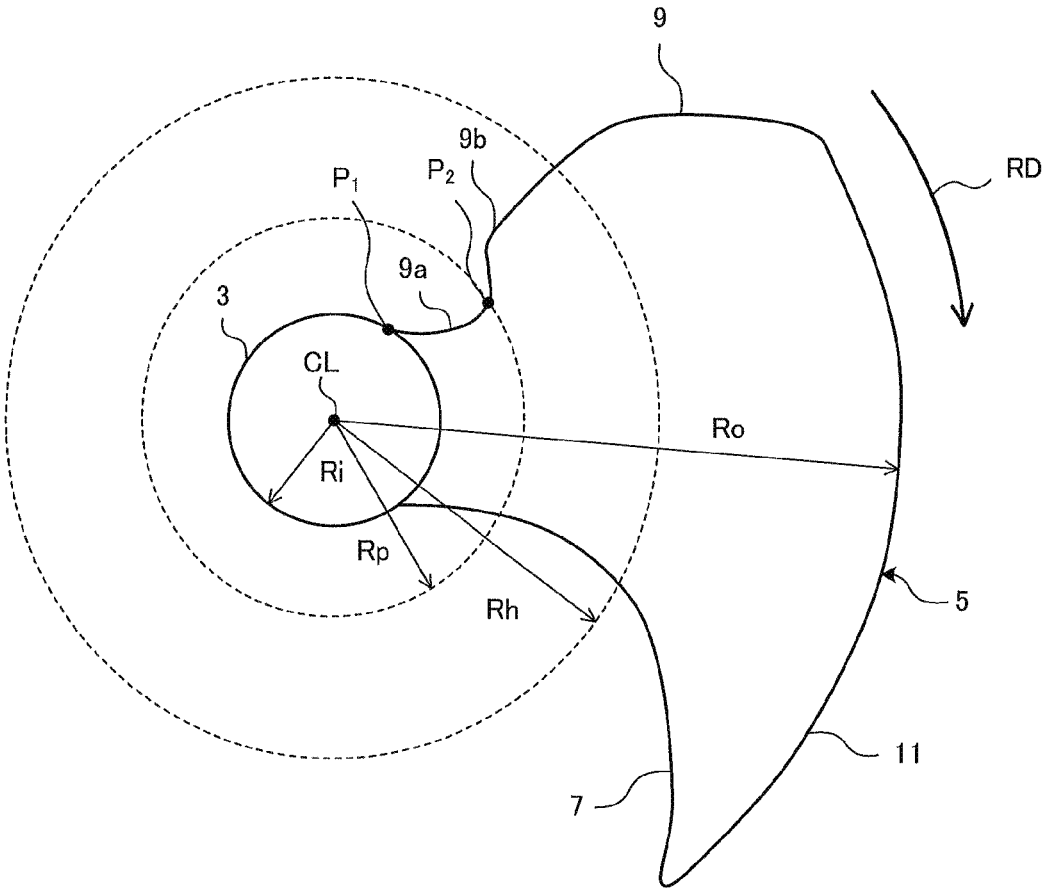
FIG. 4 illustrates the shape of the blade of the propeller fan according to Embodiment 1.

FIG. 4 is an explanatory view illustrating the shape of one of the blades of the propeller fan according to Embodiment 1. The shape as illustrated in FIG. 4 is the shape of the propeller fan 1 that is projected on the plane perpendicular to the rotation axis CL. In FIG. 4, only one of the blades 5 is illustrated.

As indicated in FIG. 4, the radius of a circle whose center is located on the rotation axis CL and which passes through the second connection point P2 is a radius Rp; the radius of a circle whose center is located on the rotation axis CL and which passes through the outer peripheral edge 11 of the blade 5 is a radius Ro; and the radius of a circle whose center is located on the rotation axis CL and which passes through the first connection point P1 is a radius Ri. Furthermore, a radius which is half the difference between the radius Ro and the radius Ri is a radius Rh. That is, the radius Rh, the radius Ro, and the radius Ri have the following relationship.

$$Rh=(Ro-Ri)/2 \quad \text{[Formula 1]}$$

In the above case, the trailing edge 9 of each blade 5 is formed such that the radius Rp of the circle whose center is located on the rotation axis CL and which passes through the second connection point P2 is smaller than the radius Rh that is half the difference between the radius Ro and the radius Ri.

Figure 5:
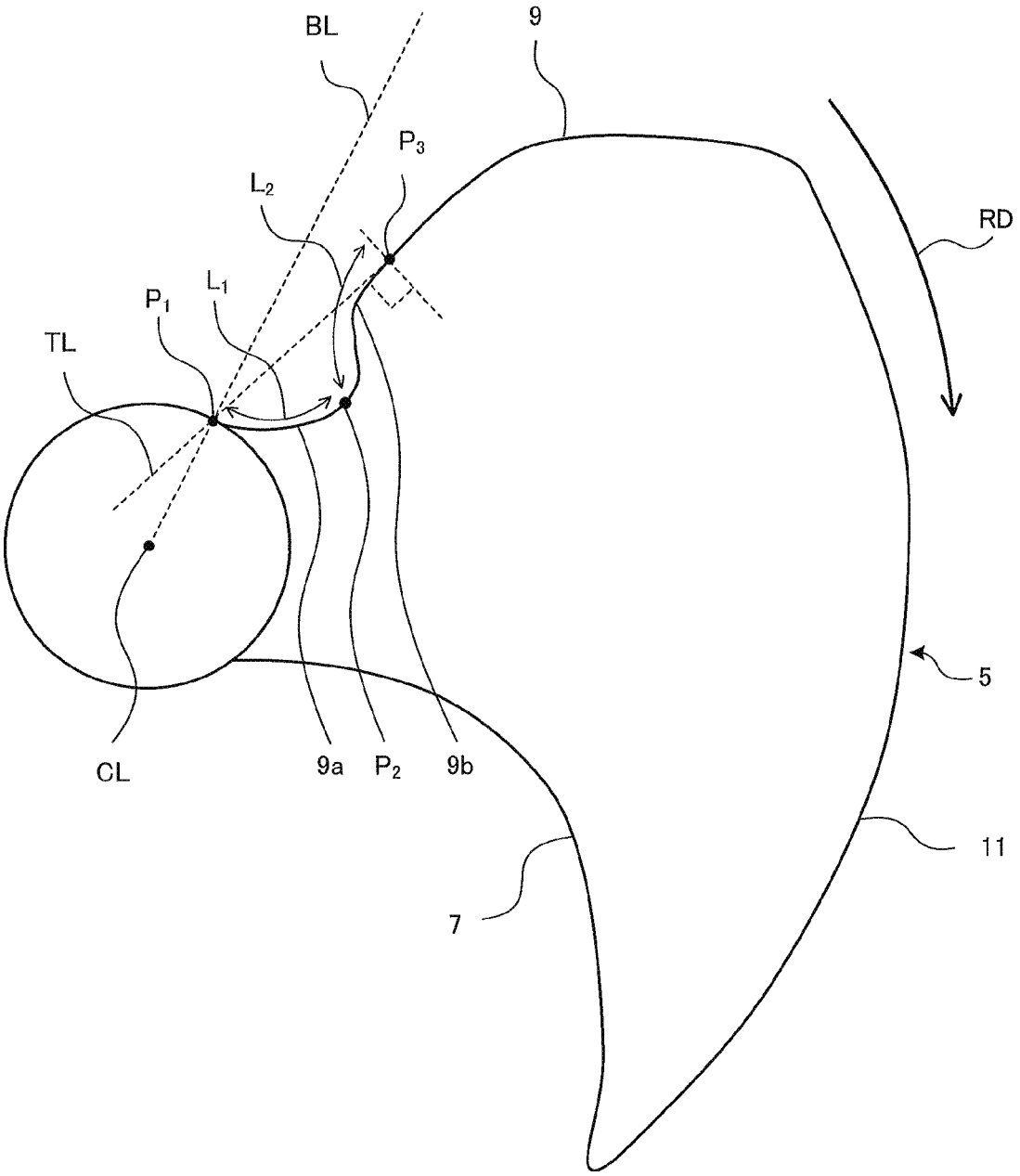
FIG. 5 illustrates the shape of the blade of the propeller fan according to Embodiment 1.

FIG. 5 is an explanatory view illustrating the shape of one of the blades of the propeller fan according to Embodiment 1. The shape in FIG. 5 is the shape of the propeller fan 1 that is projected on the plane perpendicular to the rotation axis CL. In FIG. 5, only one of the blades 5 is illustrated.

As indicated in FIG. 5, the innermost one of the points of tangency between the second trailing edge 9*b* and a tangent line TL extending through the first connection point P1 is a first vertex P3; the length of the first trailing edge 9*a* is a length L1; and the length of the second trailing edge 9*b*, which is located between the second connection point P2 and the first vertex P3 is a length L2.

In the above case, the trailing edge 9 of each blade 5 is formed such that the length L1 of the first trailing edge 9*a* is greater than or equal to the length L2 of the second trailing edge 9*b*. For example, the length L1 of the first trailing edge 9*a* of the trailing edge 9 is not more than twice the length L2 of the second trailing edge 9*b*. The length L1 of the first trailing edge 9*a* may be nearly equal to the length L2 of the second trailing edge 9*b*.

Operation

The operation of the propeller fan 1 according to Embodiment 1 will be described.

Figure 6:
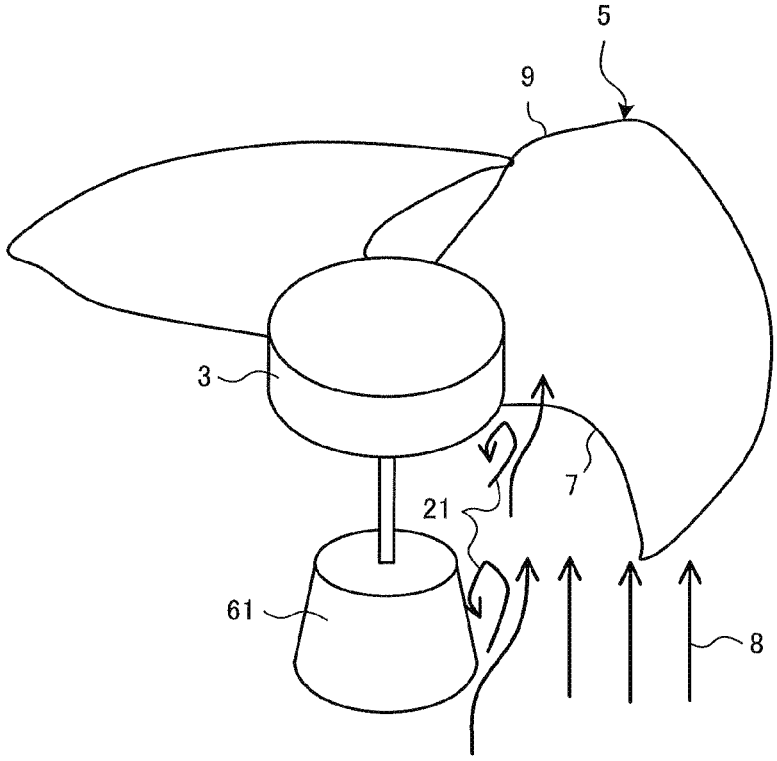
FIG. 6 schematically illustrates the propeller fan according to Embodiment 1, a motor, and airflow.

FIG. 6 schematically illustrates a motor, flows of air and the propeller fan according to Embodiment 1. In FIG. 6, depiction of one of the blades 5 is omitted as a matter of convenience for explanation.

As illustrated in FIG. 6, the boss 3 of the propeller fan 1 is attached to a fan motor 61 serving as a drive source. The boss 3 of the propeller fan 1 is rotated by a rotational force of the fan motor 61. When the fan motor 61 is rotated, air 8 flows from the leading edge 7 of a blade 5, passes between the blade 5 and another blade 5, and flows away from the trailing edge 9. When the air passes between the blades 5 while flowing along the blades 5, the flow direction of the air is changed because of the inclination and warp of the blades 5, and the momentum of the air is changed, thus raising the static pressure.

The flow of air that flows to an inner peripheral side of a blade 5 that is close to the boss 3 will be described.

The boss 3 and the fan motor 61 are located upstream of the inner peripheral side of the blade 5, the boss 3 being cylindrically formed. Thus, just before air flows through the leading edge 7 of the blade 5, the flow of the air contains turbulent flow 21. For example, the turbulent flow 21 is generated by a vortex that is generated when the fluid passes through the fan motor 61 or the boss 3. For example, the turbulent flow 21 is generated because a wind speed is locally increased when a fluid passes through a flow passage that is narrowed due to provision of the fan motor 61, that of the boss 3, or generation of the vortex.

Figure 7:
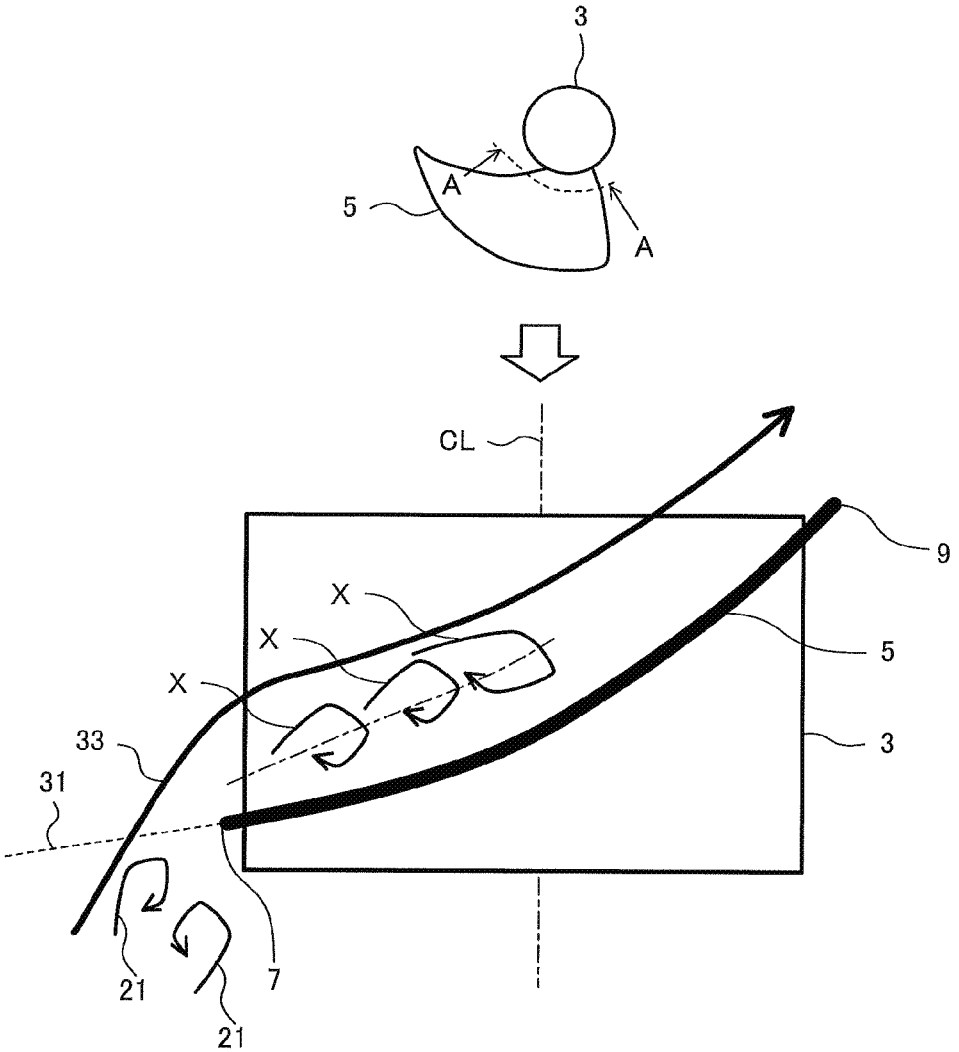
FIG. 7 is a diagram of a blade 5 taken along line A-A and illustrates flow near the blade.

FIG. 7 is a diagram illustrating part of a blade 5 that is developed along line A-A and indicating the flow of air over the blade. In FIG. 7, depiction of the other part of the blade 5 is omitted for as a matter of convenience for explanation.

As illustrated in FIG. 7, just before air flows to the leading edge 7 of the blade 5, in the case where the flow of air contains turbulent flows 21, vortexes X are generated at the leading edge 7. To be more specific, a direction 31 in which the leading edge 7 of the blade 5 extends toward the inner peripheral side, that is, a direction in which a tangent line of the leading edge 7 extends in a cross section of the blade, does not coincide with a flow direction 33 of the air that flows to the blade, and vortexes X are thus generated at the leading edge 7. The vortexes X generated at the leading edge 7 flow along the blade surface of the blade 5 and flows away from the trailing edge 9.

Figure 8:
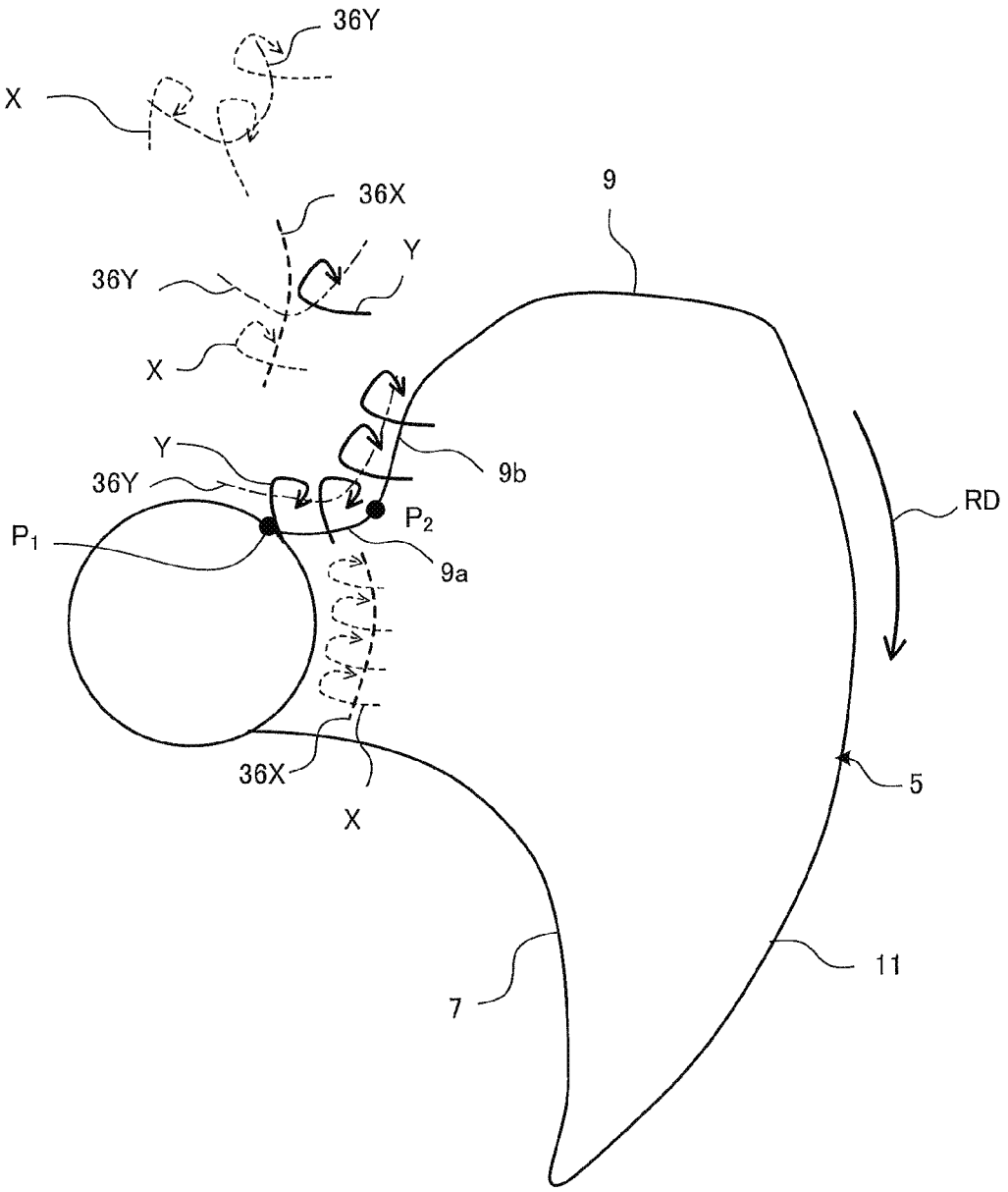
FIG. 8 schematically illustrates airflow that passes through a blade surface of the propeller fan according to Embodiment 1.

FIG. 8 schematically illustrates airflow that passes over the blade surface of the propeller fan according to Embodiment 1. The shape as illustrated in FIG. 8 is the shape of the propeller fan 1 that is projected on the plane perpendicular to the rotation axis CL. In FIG. 8, only one of the blades 5 is illustrated.

As illustrated in FIG. 8, vortexes X generated at the leading edge 7 flow over the blade surface of a blade 5 along an axis 36X, and flow away from the trailing edge 9. Also, in airflow that flows away from the trailing edge 9, vortexes Y having an axis 36Y along the trailing edge 9 are generated. To be more specific, in the airflow having flowed away from the trailing edge 9, on the inner peripheral side of the blade 5, vortexes Y having an axis 36Y that extends along the first trailing edge 9*a* and the second trailing edge 9*b*, that is, that is curved in the rotation direction RD, are generated.

Therefore, a vortex Y that flows away from the first trailing edge 9*a* and a vortex Y that flows away from the second trailing edge 9*b* collide with each other, and these vortexes Y are weakened by friction between airflows that form the vortexes Y. Also, the vortexes Y that flow away from the first trailing edge 9*a* and the second trailing edge 9*b* are further greatly twisted and the curvature of the axis 36 increases as the vortexes Y flow more downstream, and the airflows that form the vortexes Y more easily collide with each other and the vortexes Y are further greatly weakened as the vortexes Y flow more downstream.

The axis 36X of vortexes X that flow over the blade surface of the blade 5 intersects the axis 36Y of vortexes Y at the trailing edge 9. Thus, the vortexes Y that flow away from the first trailing edge 9*a* and the second trailing edge 9*b* collide with the vortexes X, and the vortexes Y and the vortexes X are weakened by friction between the airflow that forms the vortexes Y and the airflow that forms the vortexes X.

Advantages

In Embodiment 1, as described above, the trailing edge 9 of the blade 5 includes the first trailing edge 9*a* adjacent to the boss 3 and the second trailing edge 9*b* adjacent to the first trailing edge 9*a*. The second connection point P2 is more forward than the reference line BL in the rotation direction RD, and the second trailing edge 9*b* is more rearward than the second connection point P2 in the rotation direction RD.

Therefore, vortexes Y generated at the trailing edge 9 of the blade 5 flow away therefrom while having a curved axis 36Y and are weakened by friction therebetween. Furthermore, vortexes X having the axis 36X are generated at the leading edge 7 of the blade 5 and join on a downstream side, the vortexes Y generated at the trailing edge 9 of the blade 5, and the vortexes X and the vortexes Y are weakened by friction therebetween. Thus, the turbulence of the airflow is reduced, and the energy loss is also reduced. Furthermore, it is possible to achieve a propeller fan in which the turbulence of airflow that is caused by vortexes X and Y is reduced and noise is reduced.

In the following description, the advantages of the propeller fan 1 according to Embodiment 1 are described while referring to the comparison between the propeller fan of Embodiment 1 and those of comparative examples. In the following description of propeller fans of the comparative examples, components that are the same as or equivalent to those of the propeller fan 1 according to Embodiment 1 will be denoted by the same reference signs.

Comparative Example 1

Figure 9:
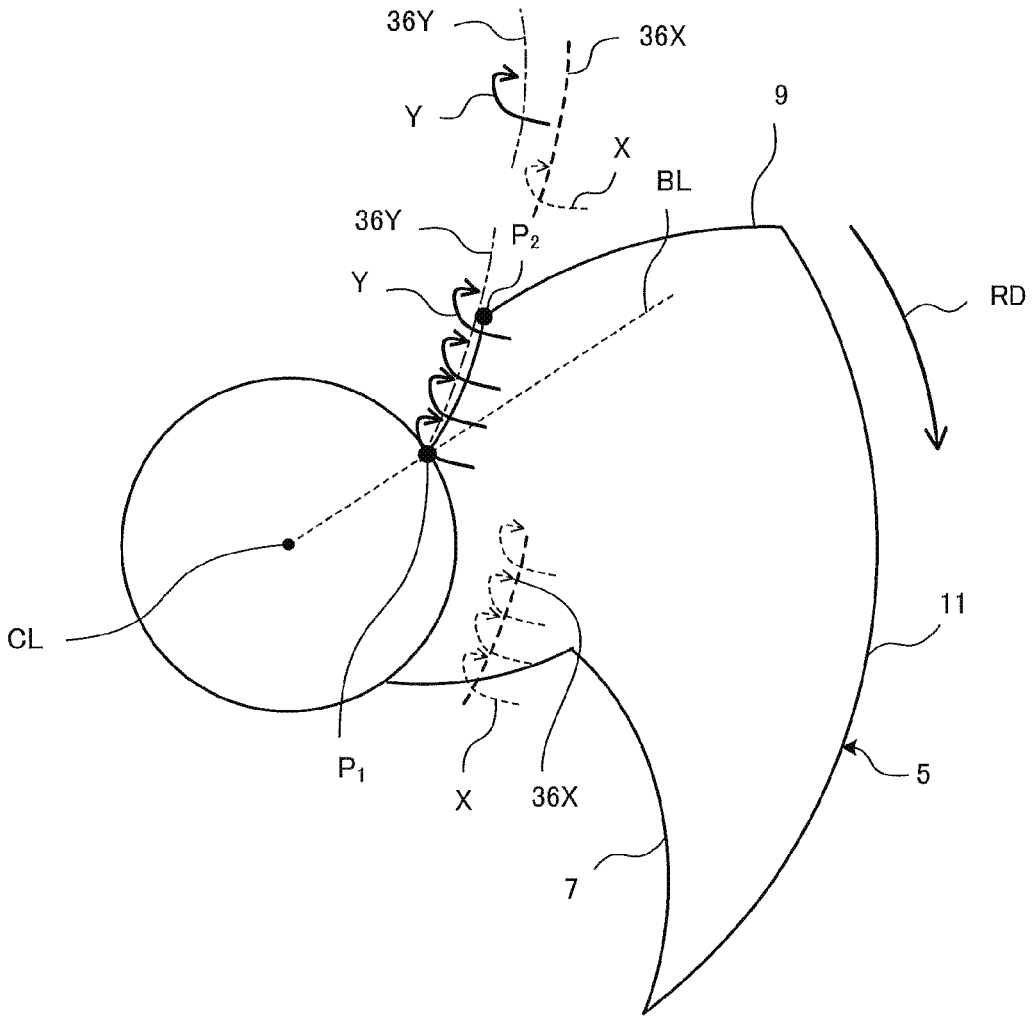
FIG. 9 illustrates the shape of a blade of a propeller fan in a comparative example 1.

FIG. 9 illustrates the shape of one of blades of a propeller fan of comparative example 1. The shape as illustrated in FIG. 9 is the shape of a propeller fan 1 that is projected on the plane perpendicular to the rotation axis CL. In FIG. 9, only one of blades 5 is illustrated.

As illustrated in FIG. 9, in the propeller fan 1 of comparative example 1, the second connection point P2 is located rearward of the reference line BL in the rotation direction RD. That is, part of the trailing edge 9 of that is located on the inner peripheral side of a blade 5 is formed to extend along a blowing direction of airflow.

Therefore, in the propeller fan of comparative example 1, the direction of the axis 36X of vortexes X that have flowed over the blade surface is the same as that of the axis 36Y of vortexes Y generated at the trailing edge 9. Therefore, the vortexes Y and the vortexes X do not cancel each other, and remain on a downstream side, thus causing an energy loss. In addition, noise is made by the turbulence of airflows that form the vortexes X and the vortexes Y.

By contrast, in the propeller fan 1 according to Embodiment 1, the axis 36X of the vortexes X and the axis 36Y of the vortexes Y intersect each other at the trailing edge 9. Therefore, it is possible to obtain the above advantages.

Comparative Example 2

Figure 10:
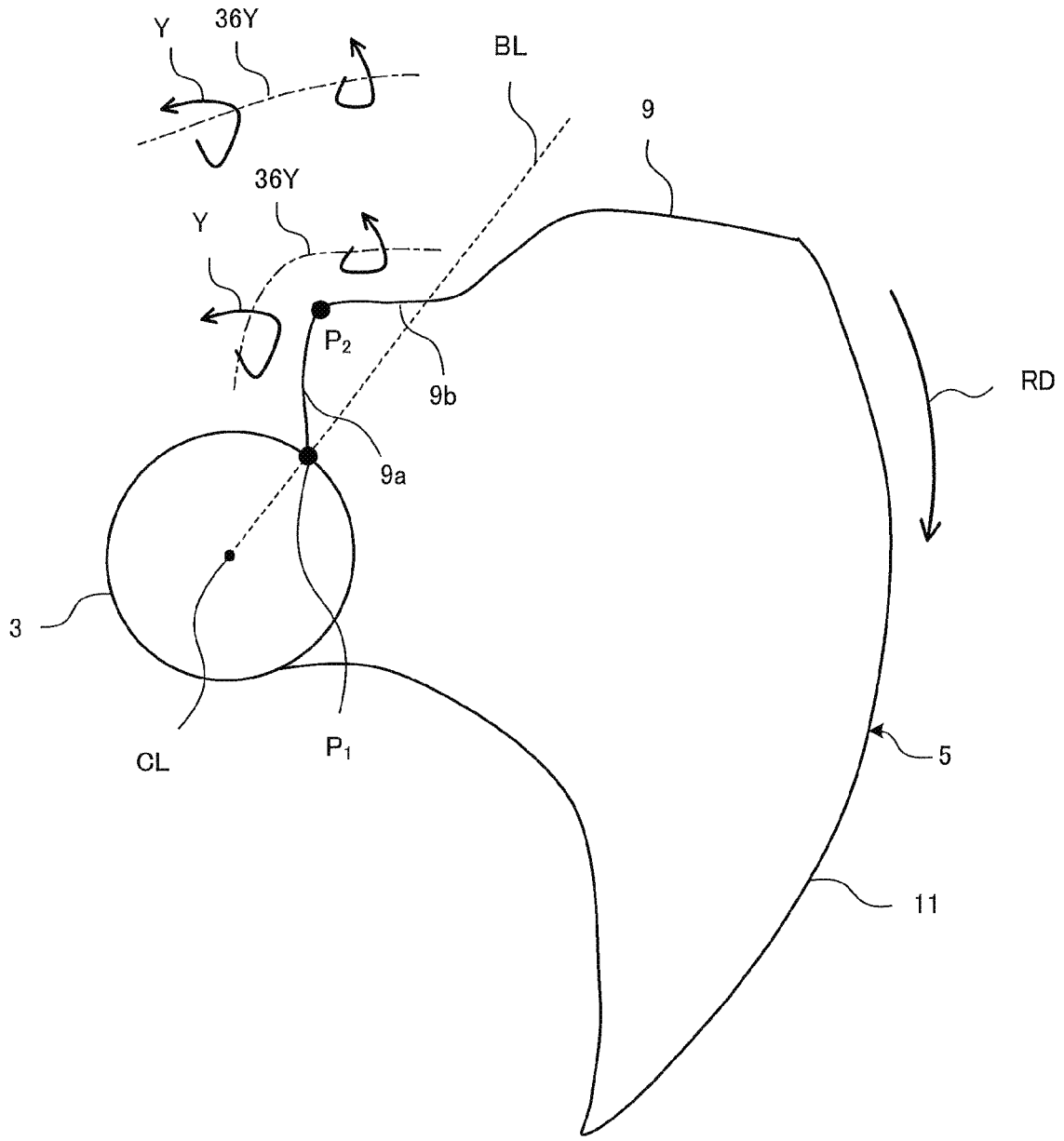
FIG. 10 illustrates the shape of a blade of a propeller fan in a comparative example 2.

FIG. 10 illustrates the shape of one of blades of a propeller fan of comparative example 2. The shape as illustrated in FIG. 10 is the shape of a propeller fan 1 that is projected on the plane perpendicular to the rotation axis CL. In FIG. 10, only one of blades 5 is illustrated.

In the propeller fan 1 of comparative example 2, as illustrated in FIG. 10, the second connection point P2 is located rearward of the reference line BL in the rotation direction RD, and the first trailing edge 9*a* and the second trailing edge 9*b* are also located rearward of the reference line BL in the rotation direction RD.

Therefore, in the propeller fan of comparative example 2, on the inner peripheral side of the blade 5, vortexes Y are generated to have an axis 36Y that is curved in the opposite direction to the rotation direction RD and along the first trailing edge 9*a* and the second trailing edge 9*b*. Consequently, vortexes Y that have flowed away from the first trailing edge 9*a* and vortexes Y that have flowed away from the second trailing edge 9*b* are separated from each other, and airflows that form those vortexes Y thus do not collide with each other. Therefore, the vortexes Y are not weakened.

By contrast, in the propeller fan 1 according to Embodiment 1, vortexes Y that have flowed away from the first trailing edge 9*a* and vortexes Y that have flowed away from the second trailing edge 9*b* collide with each other. Therefore, it is possible to obtain the above advantages.

Comparative Example 3

Figure 11:
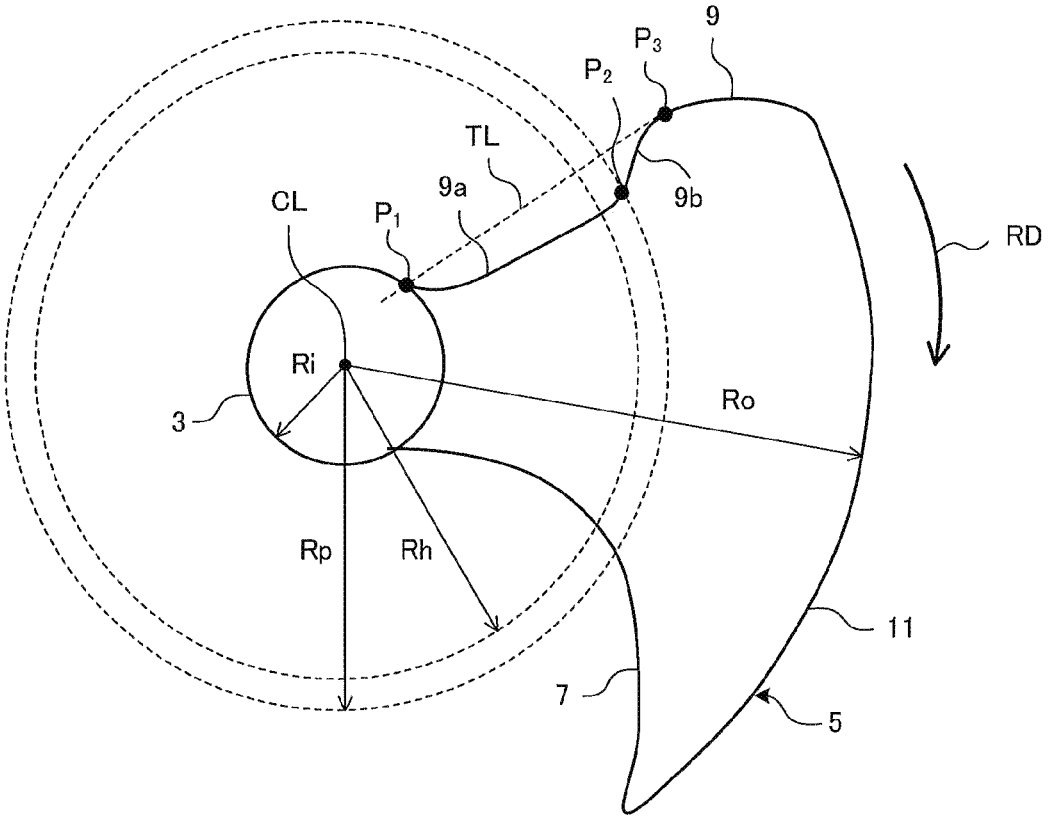
FIG. 11 illustrates the shape of a blade of a propeller fan in a comparative example 3.

FIG. 11 illustrates the shape of one of blades of a propeller fan of comparative example 3.

Figure 12:
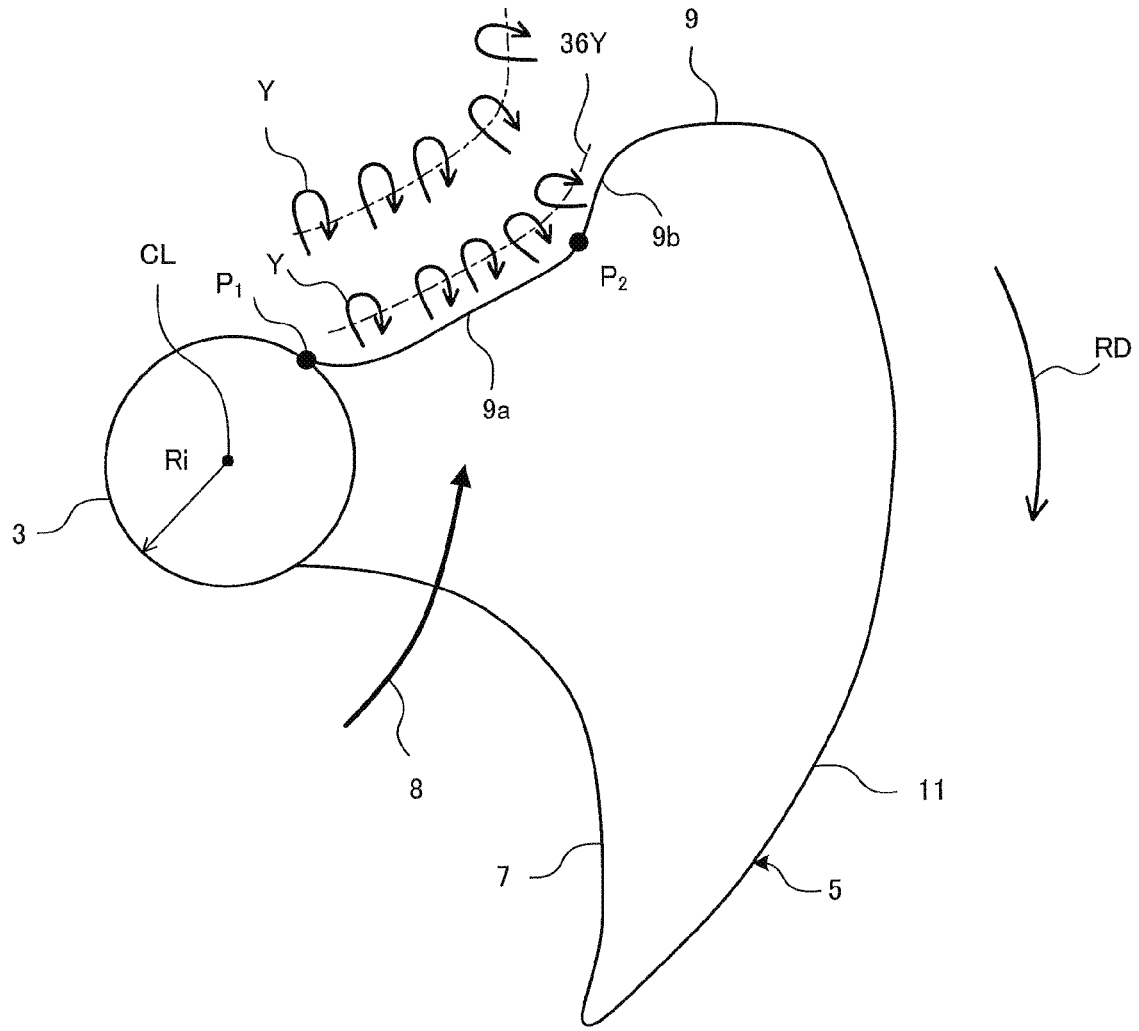
FIG. 12 schematically illustrates airflow that passes through a blade surface of the propeller fan in the comparative example 3.

FIG. 12 schematically illustrates airflow that passes over the blade surface of a blade at the propeller fan of comparative example 3.

The shapes as illustrated in each of FIGS. 11 and 12 is the shape of a propeller fan 1 that is projected on the plane perpendicular to the rotation axis CL. In FIGS. 11 and 12, only one of blades 5 is illustrated.

As illustrated in FIG. 11, in the propeller fan 1 of comparative example 3, the radius Rp of a circle whose center is located on the rotation axis CL and which passes through the second connection point P2 is greater than the radius Rh that is half the difference between the radius Ro and the radius Ri. The length L1 of the first trailing edge 9*a* exceeds twice the length L2 of the second trailing edge 9*b*. Furthermore, as illustrated in FIG. 12, in the propeller fan 1 of comparative example 3, the shape of the axis 36Y that extends along the first trailing edge 9*a* and the second trailing edge 9*b* is closer to that of a straight line extending in the radial direction. Furthermore, the number of vortexes Y that flow away from the first trailing edge 9*a* is larger than that of vortexes Y that flow away from the second trailing edge 9*b*.

Therefore, in the propeller fan of comparative example 3, the vortexes Y that flow away from the first trailing edge 9*a* and the vortexes Y that flow away from the second trailing edge 9*b* do not easily collide with each other, as a result of which they are not easily weakened by each other.

By contrast, in the propeller fan 1 according to Embodiment 1, vortexes Y that have flowed away from the first trailing edge 9*a* and vortexes Y that have flowed away from the second trailing edge 9*b* collide with each other Therefore, it is possible to obtain the same advantages.

Embodiment 2

A propeller fan 1 according to Embodiment 2 will be described by referring mainly to the differences between Embodiments 1 and 2. Components that are the same as those in Embodiment 1 will be denoted by the same reference signs, and their descriptions will thus be omitted.

Figure 13:
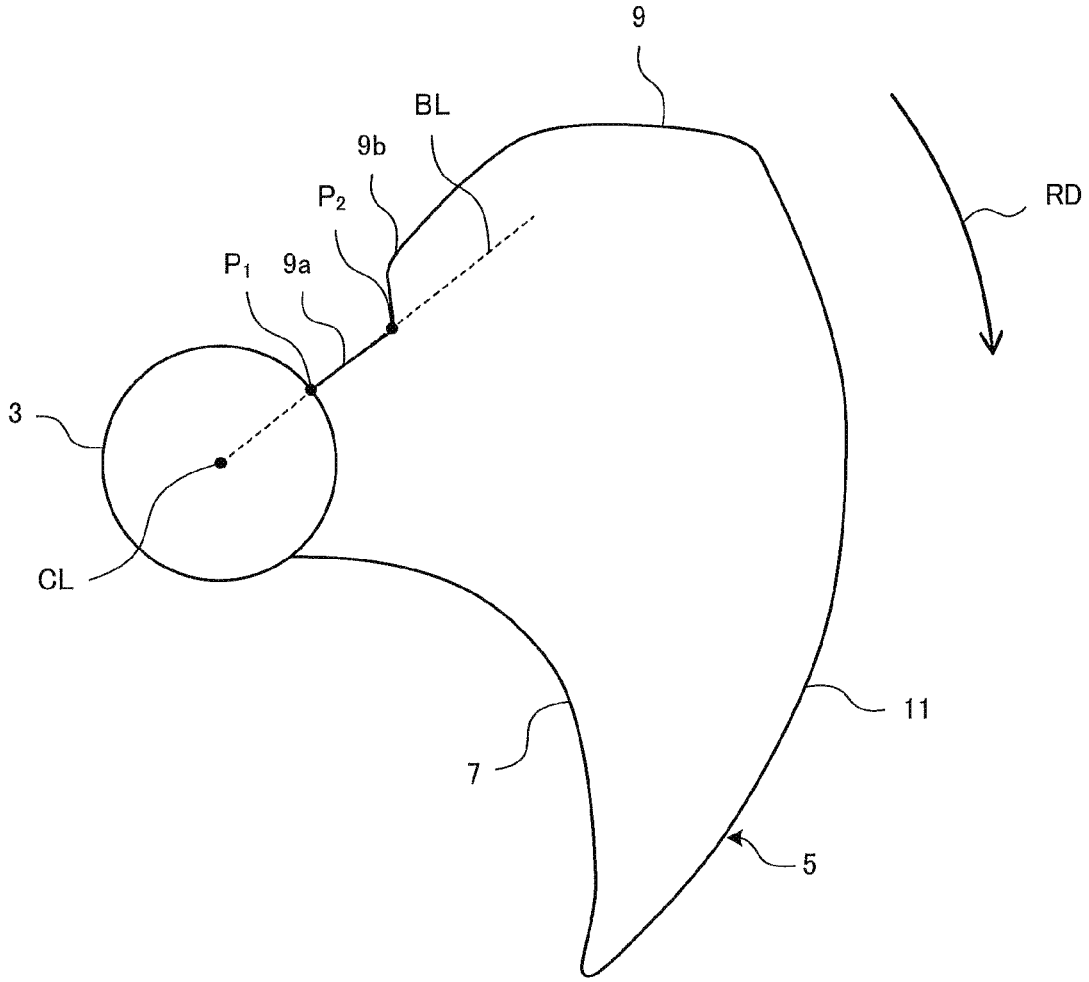
FIG. 13 illustrates the shape of a blade of a propeller fan according to Embodiment 2.

FIG. 13 illustrates the shape of one of blades of the propeller fan according to Embodiment 2. The shape as illustrated in FIG. 13 is the shape of the propeller fan 1 that is projected on the plane perpendicular to the rotation axis CL. In FIG. 13, only one of blades 5 is illustrated.

As illustrated in FIG. 13, the trailing edge 9 of each blade 5 is formed such that the second connection point P2 is located in the reference line BL. Also, the first trailing edge 9*a* of the trailing edge 9 of the blade 5 is located in the reference line BL. That is, the first trailing edge 9*a* is located in the reference line BL in such a manner as to extend from the first connection point P1 to the second connection point P2. The second trailing edge 9*b* extends rearward from the second connection point P2 such that it is located rearward of the second connection point P2 in the rotation direction RD.

Figure 14:
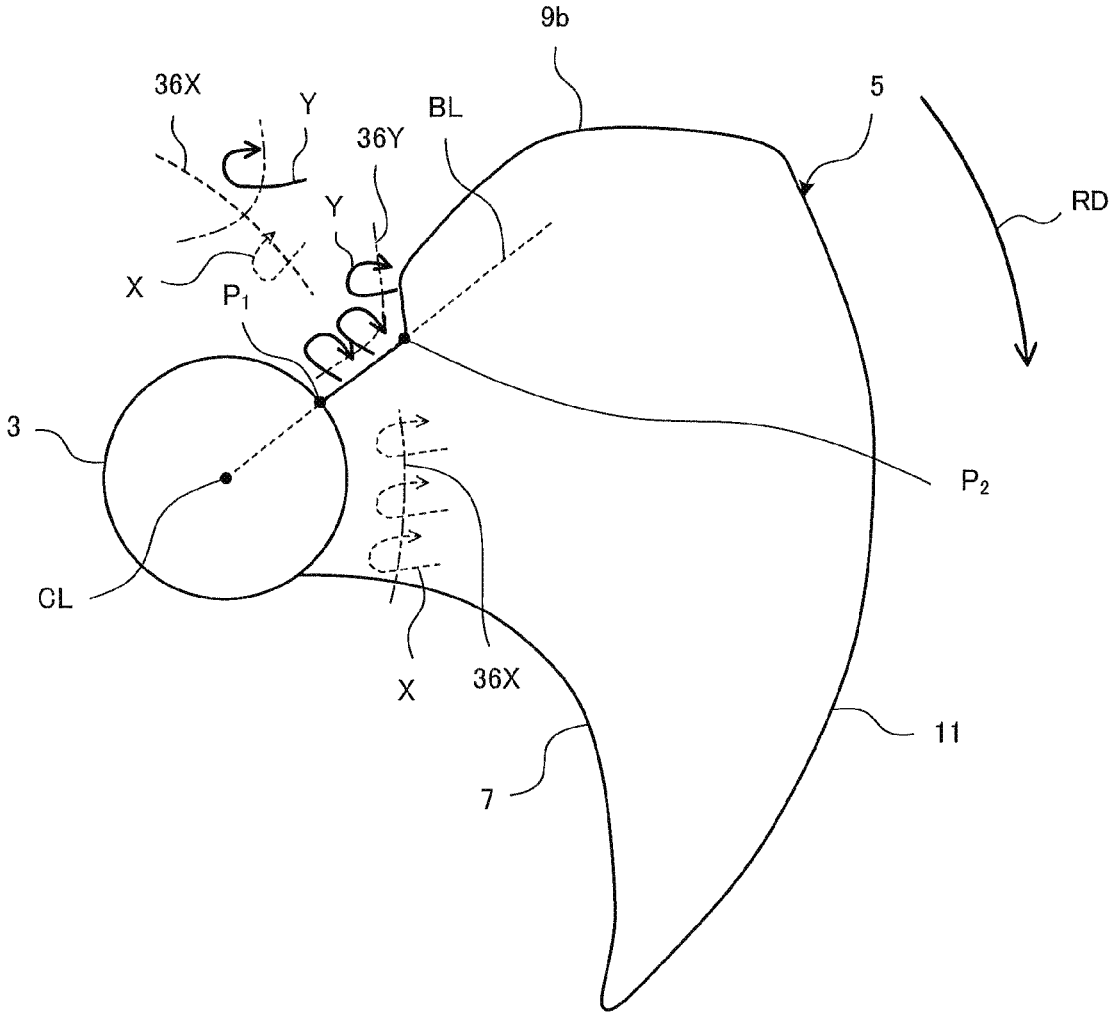
FIG. 14 schematically illustrates airflow that passes through a blade surface of the propeller fan according to Embodiment 2.

FIG. 14 schematically illustrates airflow that passes over the blade surface of the propeller fan according to Embodiment 2. The shape as illustrated in FIG. 14 is the shape of the propeller fan 1 that is projected on the plane perpendicular to the rotation axis CL. In FIG. 14, only one of the blades 5 is illustrated.

As illustrated in FIG. 14, on the inner peripheral side of each blade 5, in airflow that flows away from the trailing edge 9, vortexes Y are generated to have an axis 36Y that is curved along the first trailing edge 9*a* and the second trailing edge 9*b* and in the rotation direction RD.

Because of the above configuration, vortexes Y that have flowed away from the first trailing edge 9*a* and vortexes Y that have flowed away from the second trailing edge 9*b* collide with each other, and are thus weakened by friction between airflows that form those vortexes Y as in Embodiment 1. As the vortexes Y that have flowed away from the first trailing edge 9*a* and the second trailing edge 9*b* moves further downstream, the vortexes Y are further twisted, and the curvature of the axis 36Y increases, and on the other hand, as the vortexes Y moves further downstream, the airflows that form the vortexes Y more easily collide with each other, and the vortexes Y are weakened.

Furthermore, the axis 36X of the vortexes X that have flowed over the blade surface of the blade 5 intersects the axis 36Y of the vortexes Y at the trailing edge 9. Therefore, the vortexes Y that have flowed away from the first trailing edge 9*a* and the second trailing edge 9*b* collide with the vortexes X, and the vortexes Y and the vortexes X are weakened by friction between the airflows that form the vortexes Y and the vortexes X.

Embodiment 3

A propeller fan 1 according to Embodiment 3 will be described by referring mainly to the differences between Embodiment 3 and Embodiments 1 and 2. Components that are the same as those in Embodiments 1 and 2 will be denoted by the same reference signs, and their descriptions will thus be omitted.

Figure 15:
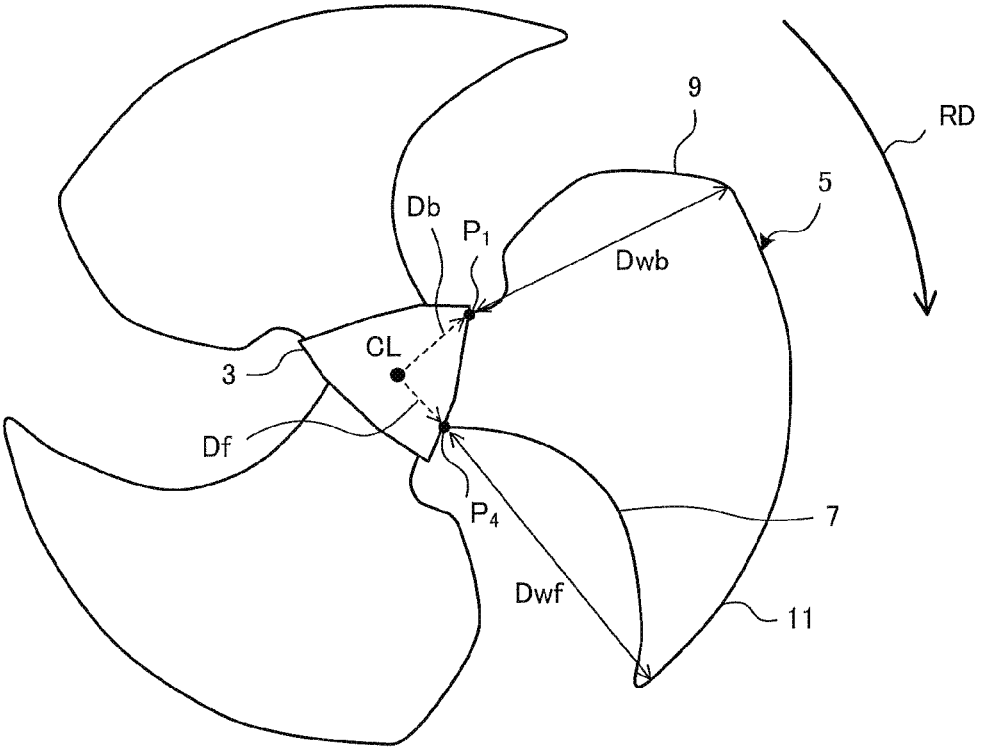
FIG. 15 illustrates a shape obtained by projecting a propeller fan according to Embodiment 3 on a plane perpendicular to the rotation axis.

The shape as illustrated in FIG. 15 is the shape of the propeller fan according to Embodiment 3 that is projected on the plane perpendicular to the rotation axis. Also, the shape as illustrated in FIG. 15 is that as viewed from surfaces of blades 5 that are moved to push airflow, that is, pressure surfaces of the blades 5.

As indicated in FIG. 15, a connection point between the leading edge 7 and the boss 3 is a third connection point P4; the distance between the rotation axis CL and the third connection point P4 is a distance Df; and the distance between the rotation axis CL and the first connection point P1 is a distance Db.

In the above case, the boss 3 is formed such that the distance Db between the rotation axis CL and the first connection point P1 to greater than the distance Df between the rotation axis CL and the third connection point P4. In other words, each blade 5 is formed such that a distance Dwf that is the distance between the third connection point P4 and the outer peripheral edge 11 is greater than a distance Dwb that is the distance between the first connection point P1 and the outer peripheral edge 11. That is, a side wall of the boss 3 is formed such that the trailing edge 9 is located outward of the leading edge 7 in the radial direction.

Figure 16:
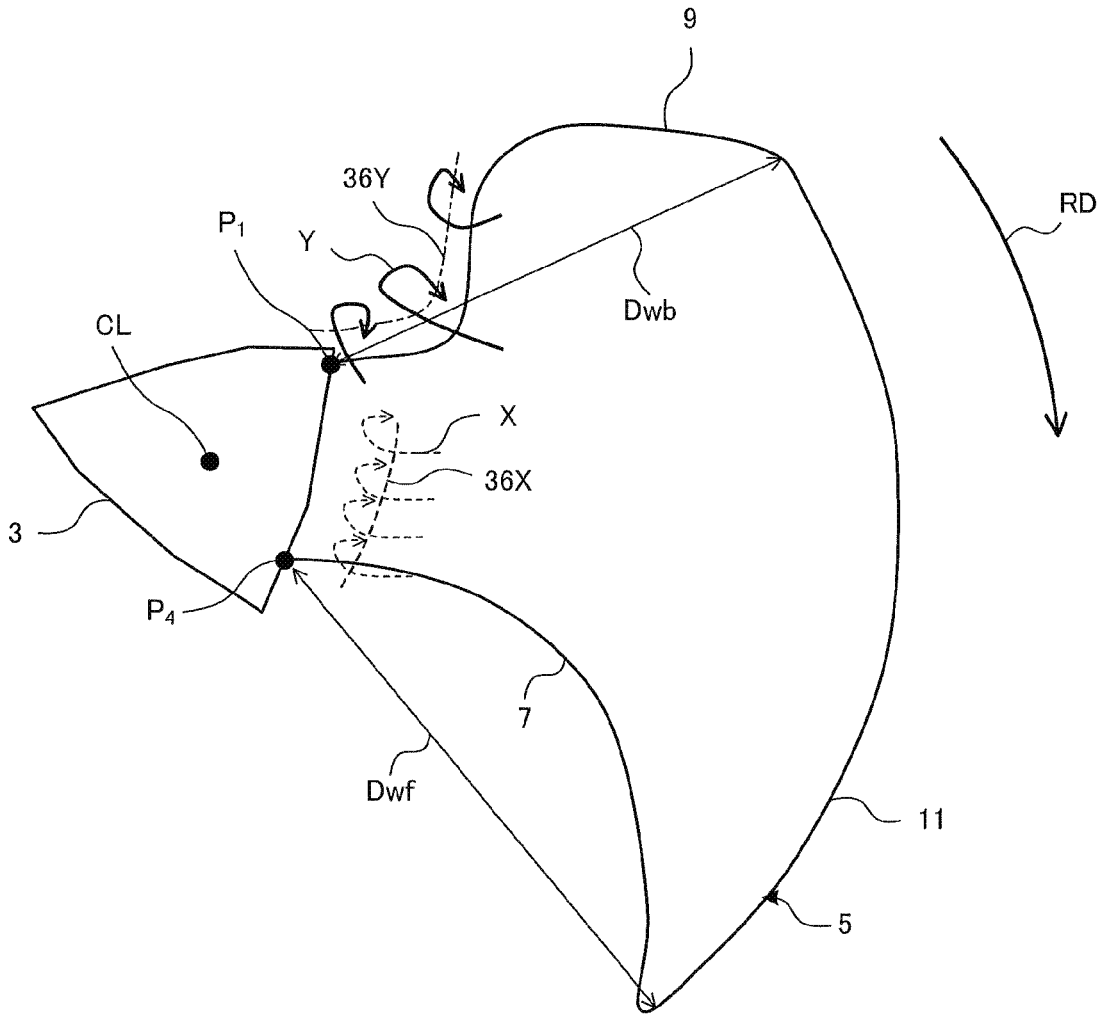
FIG. 16 schematically illustrates airflow that passes through a blade surface of the propeller fan according to Embodiment 3.

FIG. 16 schematically illustrates airflow that passes over the blade surface of the propeller fan according to Embodiment 3. The shape as illustrated in FIG. 16 is the shape of the propeller fan 1 that is projected on the plane perpendicular to the rotation axis CL. In FIG. 16, only one of the blades 5 is illustrated.

As illustrated in FIG. 16, the distance between both sides of the blade surface over which vortexes X generated at the leading edge 7 of each blade flow decreases from the leading edge 7 to the trailing edge 9; that is, from the distance Dwf to the distance Dwb. That is, a region through which the airflow passes is located between the side wall of the boss 3 and the outer peripheral edge 11, and is narrowed in the above manner.

Thus, the vortexes X that pass over the blade surface flows through a narrower region and thus flow at a higher speed as the vortexes X approaches the trailing edge. That is, the vortexes X collide with the vortexes Y generated at the trailing edge 9 at a higher speed, thus further effectively weakening the vortexes Y generated at the trailing edge 9.

Therefore, the turbulence of the airflow is further reduced, as compared with Embodiment 1, and the energy loss is further reduced. Furthermore, it is possible to provide a propeller fan in which the turbulence of the airflows that is caused by the vortexes X and Y can be further reduced and noise can be further reduced, as compared with that of Embodiment 1.

Embodiment 4

A propeller fan 1 according to Embodiment 4 will be described by referring mainly to the differences between Embodiment 4 and Embodiments 1 to 3. Components that are the same as those in Embodiments 1 to 3 will be denoted by the same reference signs, and their descriptions will thus be omitted.

Figure 17:
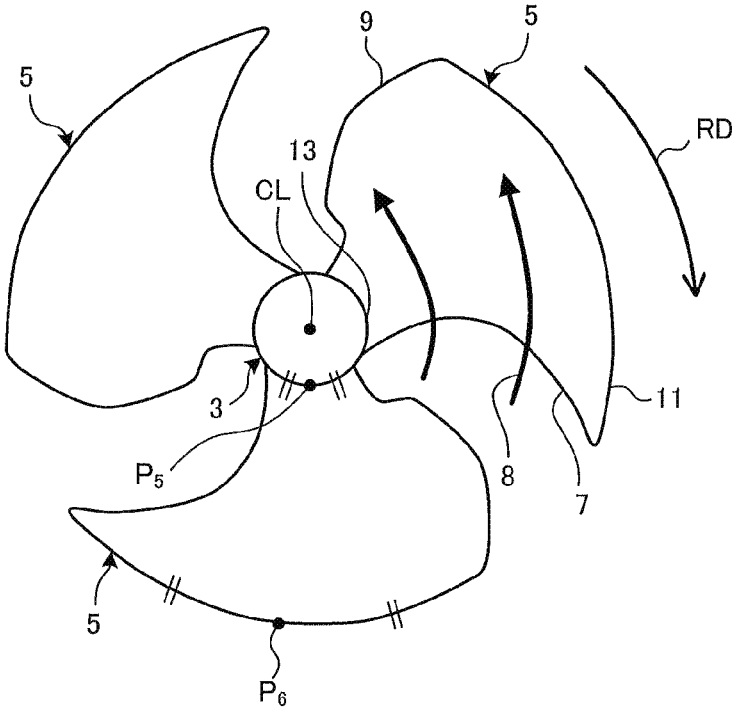
FIG. 17 illustrates a shape obtained by projecting a propeller fan according to Embodiment 4 on a plane perpendicular to the rotation axis.

The shape as illustrated in FIG. 17 is the shape of the propeller fan according to Embodiment 4 that is projected on the plane perpendicular to the rotation axis. It should be noted that the shape as illustrated in FIG. 17 is that as viewed from surfaces of blades 5 that are moved to push airflow, that is, pressure surfaces thereof.

Figure 18:
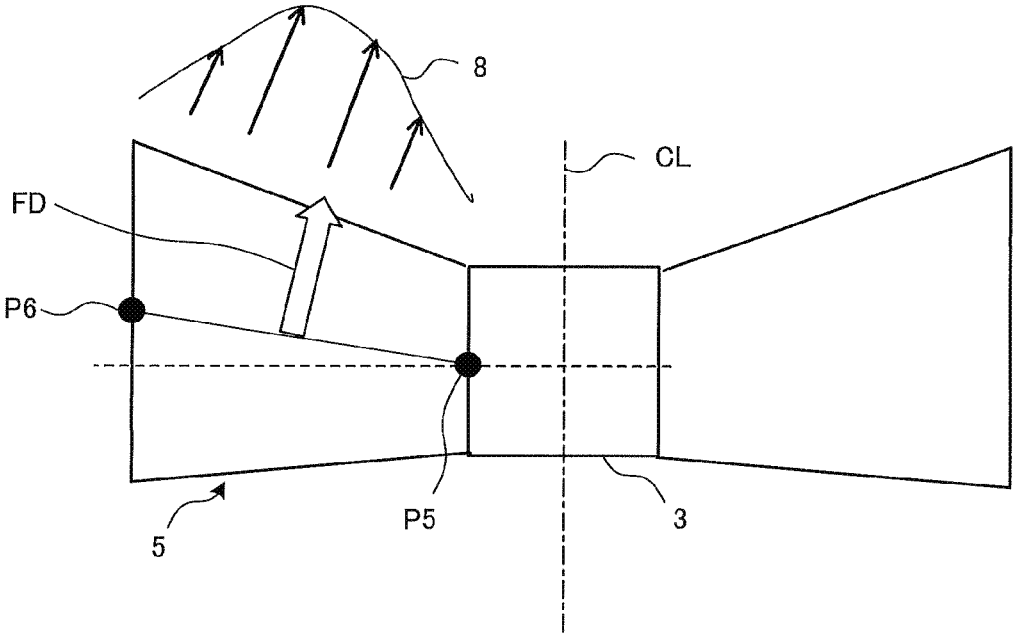
FIG. 18 illustrates a shape obtained by rotationally projecting the propeller fan according to Embodiment 4 on a plane containing the rotation axis.

The shape as illustrated in FIG. 18 is the shape of the propeller fan according to Embodiment 4 that is rotationally projected on a plane in which the rotation axis is located. That is, FIG. 18 illustrates a side view of a region in which the blades 5 are located when the propeller fan 1 is rotated.

As illustrated in FIGS. 17 and 18, a middle point of an arc that extends along the inner peripheral edge 13 of each blade 5, has a constant radius from the rotation axis CL, and connects the leading edge 7 and the trailing edge 9 is a first middle point P5. That is, a middle point of an arc that connects the innermost part of the leading edge 7 and the innermost part of the trailing edge 9 and has a constant radius from the rotation axis CL is the first middle point P5. A middle point of an arc that extends along the outer peripheral edge 11 of the blade 5, has a constant radius from the rotation axis CL, and connects the leading edge 7 and the trailing edge 9 is a second middle point P6.

In the above case, each blade 5 is formed such that the first middle point P5 is located upstream of the second middle point P6 in a direction along the rotation axis CL (see FIG. 18). That is, the blade 5 is a so-called rearward inclined blade. It should be noted that the configuration of the trailing edge 9 is the same as that of any of Embodiments 1 to 3.

Since each blade 5 is a rearward inclined blade, it is thus formed such that it is moved to push air inwardly in the radial direction. It is therefore possible to reduce airflow 8 that moves away from the outer peripheral edge 11, and reduce the turbulence of the airflow 8.

Furthermore, since the airflow 8 is airflow toward the inner peripheral side of each blade 5, even if vortexes X generated on the inner peripheral side and the airflow 8 are mixed with each other, the vortexes X and the airflow 8 mixed with each other and vortexes Y generated on the inner peripheral side of the trailing edge 9 of each blade 5 can weaken each other. Therefore, even in the case where rearward inclined blades are employed as blades 5, it is possible to achieve a propeller fan in which the turbulence of the airflow, the energy loss, and the noise are all reduced.

Embodiment 5

A propeller fan 1 according to Embodiment 5 will be described by referring mainly to the differences between Embodiment 5 and Embodiments 1 to 4. Components that are the same as those in Embodiments 1 to 4 will be denoted by the same reference signs, and their descriptions will thus be omitted.

Figure 19:
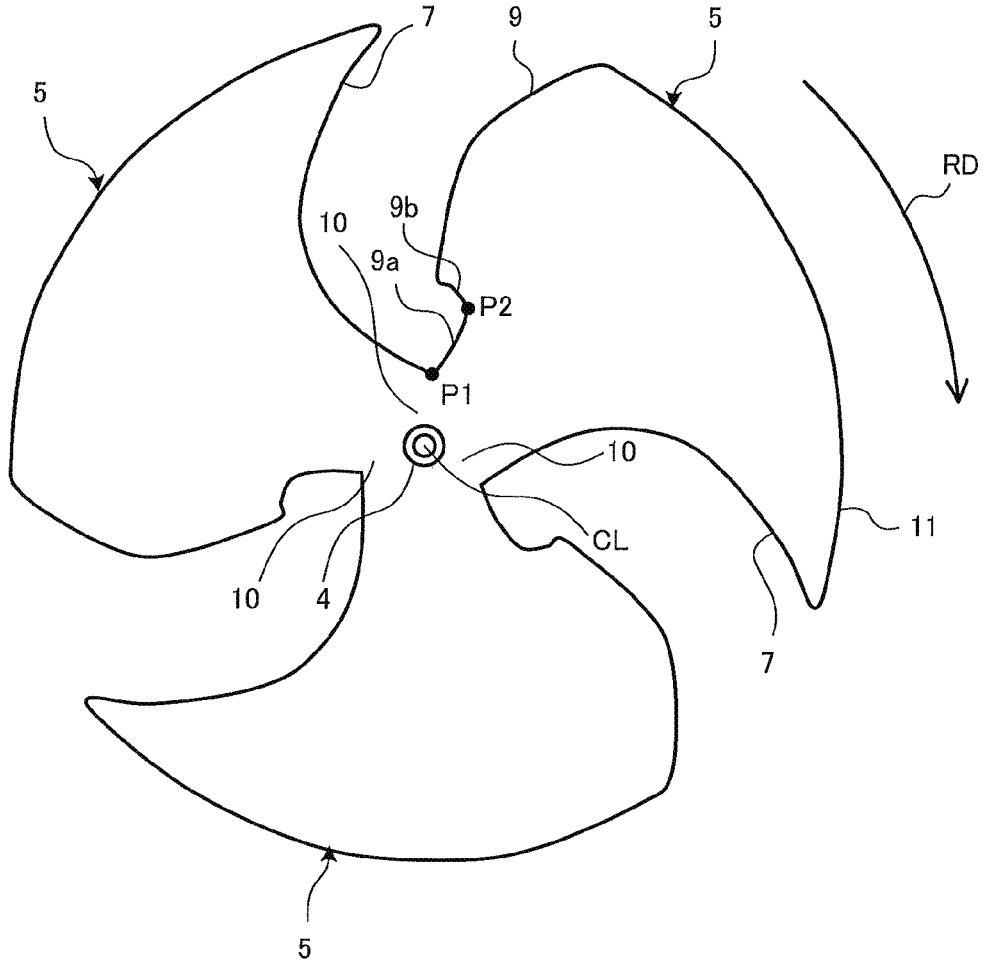
FIG. 19 illustrates a shape obtained by projecting a propeller fan according to Embodiment 5 on a plane perpendicular to the rotation axis.

The shape as illustrated in FIG. 19 is the shape of the propeller fan according to Embodiment 5 that is projected on the plane perpendicular to the rotation axis. Also, the shape as illustrated in FIG. 19 is that as viewed from surfaces of blades 5 that are moved to push airflow, that is, pressure surfaces.

As illustrated in FIG. 19, the propeller fan 1 includes a shaft 4 provided along the rotation axis CL, blades 5 disposed around the shaft 4, and joints 10 each joining associated two of the blades 5 that are adjacent to each other in the circumferential direction.

The shaft 4 is rotated around the rotation axis CL. The joints 10 are each formed in the shape of, for example, a plate, and are adjacent to each other and disposed around the shaft 4. Each joint 10 joins the trailing edge 9 of a forward one of associated two of the blades 5 adjacent to each other in the circumferential direction and the reading edge 7 of the other of the associated two blades 5, the forward one of the associated two blades being located forward of the above other blade 5 in the rotation direction RD.

The propeller fan 1 is a so-called boss-less propeller fan that does not include the boss 3. The shaft 4, the blades 5, and the joints 10 are integrally formed of resin. That is, the shaft 4, the blades 5, and the joints 10 form blades united integral with each other.

The trailing edge 9 of each blade 5 has the same configuration as that of any of Embodiments 1 to 4. That is, the first trailing edge 9*a* is innermost part of the trailing edge 9. The second trailing edge 9*b* is part of the trailing edge 9 that is adjacent to and outward of the first trailing edge 9*a*.

The innermost point of the first trailing edge 9*a* is the first connection point P1. That is, the first connection point P1 is the connection point between the trailing edge 9 of the forward one of associated two blades 5 that are adjacent to each other in the circumferential direction and the leading edge 7 of the other one of the associated two blades 5, the forward one of the associated two blades 5 being located forward of the other of the associated two blades 5 in the rotation direction RD.

In such a manner, in Embodiment 5, the blades 5 are disposed around the shaft 4, and each of the joints 10 is adjacent to the shaft 4 and joins associated two of the blades 5 that are adjacent to each other in the circumferential direction. Because of provision of this configuration, in Embodiment 5, it is possible to obtain the same advantages as in Embodiment 1.

Embodiment 6

The embodiments of the present invention each relate to a technique of achieving a higher efficiency of a propeller fan and reduction of noise to a lower level in the propeller fan. In the case where an air-sending device is provided with the fan, it can send a larger amount of air with a high efficiency. Furthermore, in the case where an air-conditioning apparatus or a water-heating outdoor unit, which is a refrigeration cycle apparatus including a compressor, a heat exchanger, and other components, is provided with the above fan, it can cause a given amount of air to pass through the heat exchanger with a low noise and a high efficiency, and achieve a lower noise and energy saving at devices. As an example of application of the above cases, Embodiment 6 will be described by referring to the case where the propeller fan 1 according to any of Embodiments 1 to 5 is applied to an outdoor unit of an air-conditioning apparatus, which is an outdoor unit provided with an air-sending device.

Figure 20:
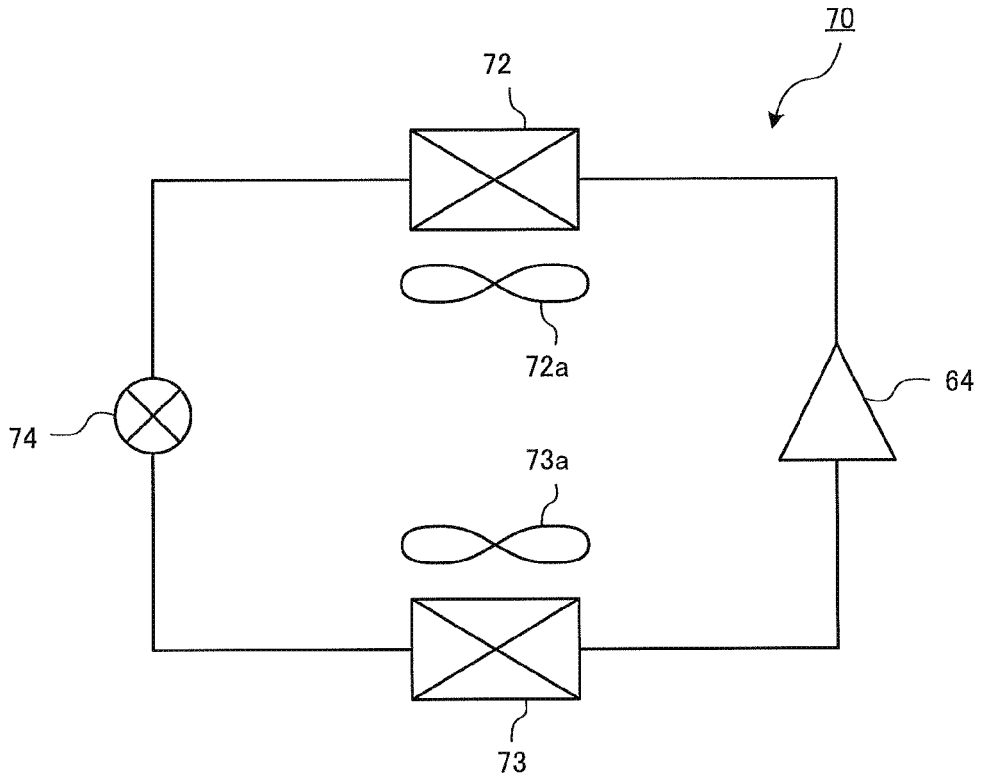
FIG. 20 schematically illustrates an air-conditioning apparatus that corresponds to a refrigeration cycle apparatus according to Embodiment 6.

FIG. 20 schematically illustrates an air-conditioning apparatus that is a refrigeration cycle apparatus according to Embodiment 6.

As illustrated in FIG. 20, the air-conditioning apparatus includes a refrigerant circuit 70 in which a compressor 64, a condenser 72, an expansion valve 74, and an evaporator 73 are sequentially connected by refrigerant pipes. The condenser 72 includes a condenser fan 72*a* that sends air for heat exchange to the condenser 72. The evaporator 73 includes an evaporator fan 73*a* that sends air for heat exchange to the evaporator 73. At least one of the condenser fan 72*a* and the evaporator fan 73*a* is the propeller fan 1 according to any of Embodiments 1 to 5. It should be noted that the refrigerant circuit 70 may include, for example, a four-way valve that changes the flow of refrigerant to switch the operation of the apparatus between a heating operation and a cooling operation.

Figure 21:
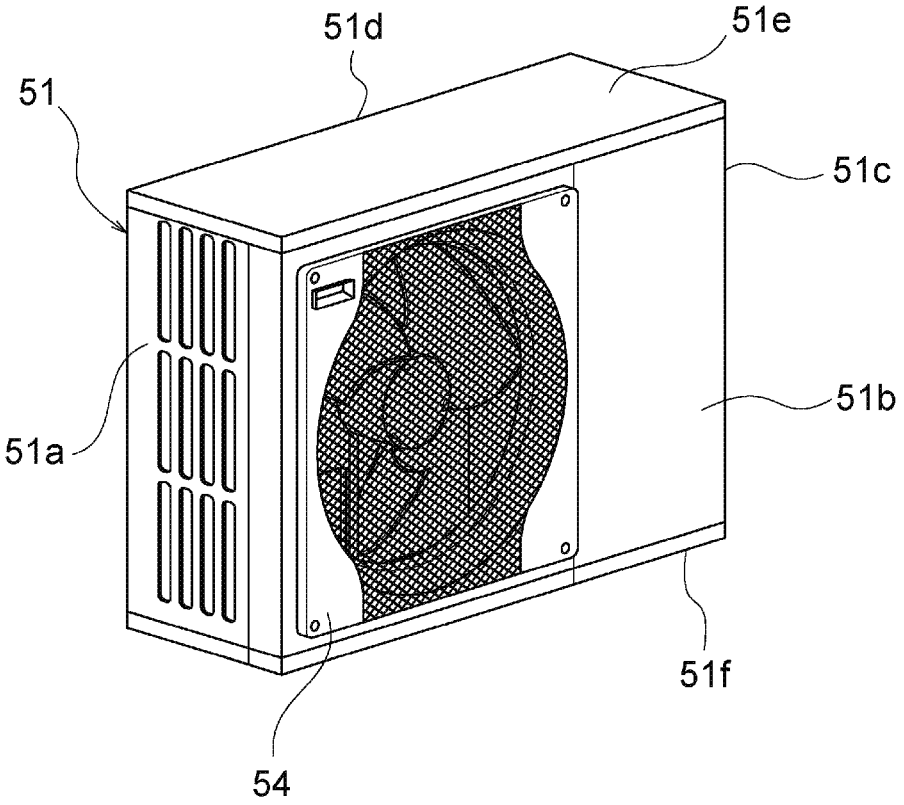
FIG. 21 illustrates a perspective view of an outdoor unit that corresponds to the air-sending device according to Embodiment 6 viewed from a position near an air outlet.

FIG. 21 illustrates a perspective view of the outdoor unit that corresponds an air-sending device in Embodiment 6, as viewed from an air-outlet side.

Figure 22:
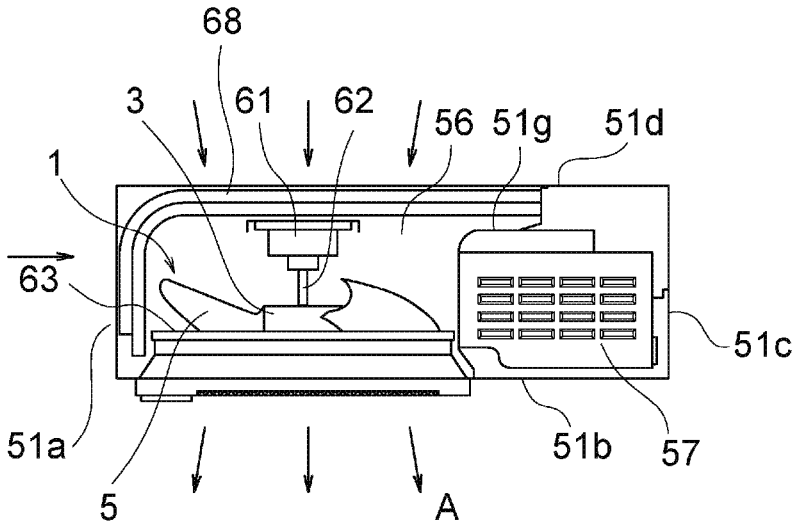
FIG. 22 illustrates a top view of a configuration of the outdoor unit.

FIG. 22 illustrates a top view of a configuration of the outdoor unit.

Figure 23:
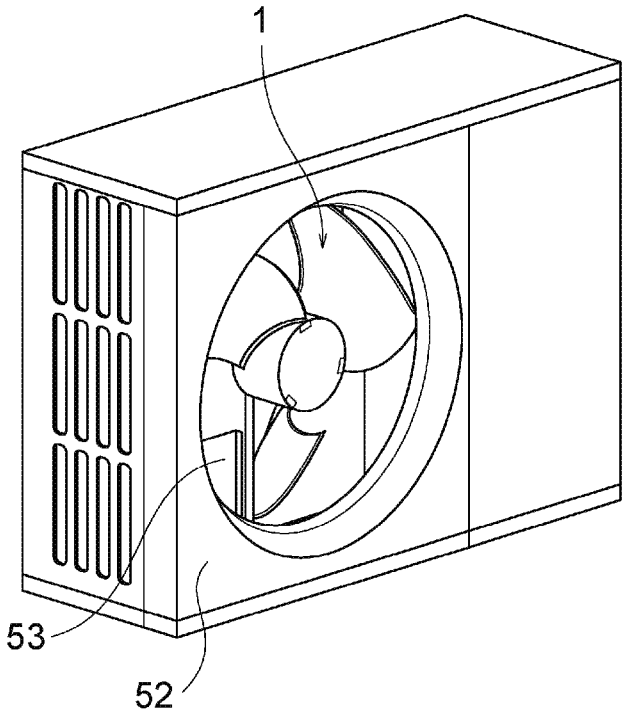
FIG. 23 illustrates the outdoor unit, with a fan grille removed.

FIG. 23 illustrates the outdoor unit, with a fan grille removed.

Figure 24:
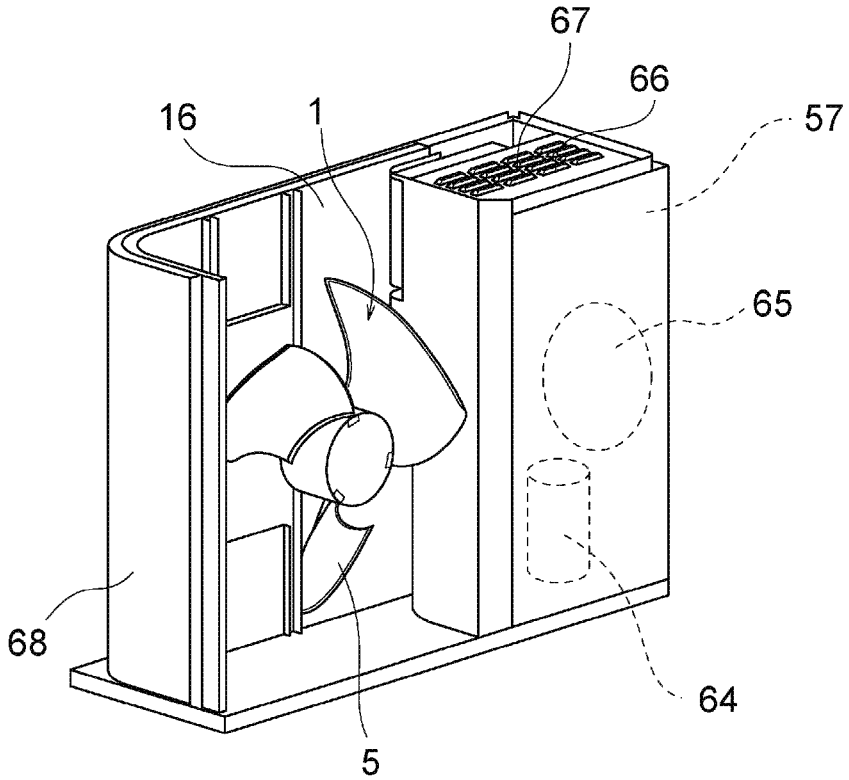
FIG. 24 illustrates an inner configuration of the outdoor unit with the fan grille, a front panel, and other components being removed.

FIG. 24 illustrates a configuration of the inside of the outdoor unit, with the fan grille, a front panel, etc., removed.

As illustrated in FIGS. 21 to 24, an outdoor unit body 51, which is a casing, is a housing that includes a pair of side surfaces, i.e., a left side surface 51*a* and a right side surface 51*c*, a front surface 51*b*, a back surface 51*d*, an upper surface 51*e*, and a bottom surface 51*f*. The side surface 51*a* and the back surface 51*d* have opening portions that allow air to flow from the outside into the housing. At the front surface 51*b*, in a front panel 52, an air outlet 53 is formed to serve as an opening portion that allow air to be blown to the outside. Furthermore, the air outlet 53 is covered by a fan grille 54 that prevents, for example, an object, from coming into contact with the propeller fan 1 in order to ensure safety. Arrows A in FIG. 22 indicate flows of air.

In the outdoor unit body 51, the propeller fan 1 is provided. The propeller fan 1 is connected to the fan motor 61, which is a drive source and located close to the back surface 51*d*, with a rotating shaft 62 interposed between the propeller fan 1 and the back surface 51*d*. The propeller fan 1 is rotated by the fan motor 61.

The inside of the outdoor unit body 51 is partitioned by a partition plate 51*g*, which is a wall, into a ventilation compartment 56 and a machine compartment 57. In the ventilation compartment 56, the propeller fan 1 is provided, and in the machine compartment 57, the compressor 64 and other components are provided. In the ventilation compartment 56, a heat exchanger 68 is provided close to the side surface 51*a* and the back surface 51*d*, and is substantially L-shaped as seen in plan view. The heat exchanger 68 operates as the condenser 72 during the heating operation, and operates as the evaporator 73 during the cooling operation.

A bell mouth 63 is provided outward of the propeller fan 1 provided in the ventilation compartment 56 in the radial direction. The bell mouth 63 is located outward of the outer peripheral edges of the blades 5, and is annular in the rotation direction of the propeller fan 1. The partition plate 51*g* is located on one of both sides of the bell mouth 63, and part of the heat exchanger 68 is located on the other side of the bell mouth 63.

A front end of the bell mouth 63 is connected to the front panel 52 of the outdoor unit in such a manner as to surround an outer periphery of the air outlet 53. The bell mouth 63 may be formed integral with the front panel 52. Alternatively, the bell mouth 63 and the front panel 52 may be made as separated components and connected to each other. In the bell mouth 63, a flow passage is provided between an air inlet and an air outlet of the bell mouth 63, and serves as a wind passage close to the air outlet 53. That is, the wind passage close to the air outlet 53 is separated from other spaces in the ventilation compartment 56 by the bell mouth 63.

The heat exchanger 68 is located on an air-intake side of the propeller fan 1, and includes a plurality of plate fins that are arranged such that surfaces of the plate fins are parallel to each other, and heat transfer tubes that extend through the fins in the direction in which the plate fins are arranged. In the heat transfer tubes, refrigerant that circulates through the refrigerant circuit flows. In the heat exchanger 68 according to Embodiment 6, the heat transfer tubes are each L-shaped along the side surface 51*a* and the back surface 51*d* of the outdoor unit body 51, and extends in a zigzag manner while extending through the fins. The heat exchanger 68 is connected to the compressor 64 by, for example, a pipe 65, and is also connected to, for example, an indoor-side heat exchanger and an expansion valve, not illustrated, thus forming the refrigerant circuit 70 of the air-conditioning apparatus. In the machine compartment 57, a substrate box 66 is provided. In the substrate box 66, a control substrate 67 is provided to control components provided in the outdoor unit.

Also, in Embodiment 6, it is possible to obtain the same advantages or similar advantages to those of Embodiments 1 to 5.

Although Embodiment 6 is described above by referring to by way of example the case where the outdoor unit of the air-conditioning apparatus is applied as the outdoor unit provided with the air-sending device, it is not limited to such a case. For example, the air-sending device can be used as, for example, an outdoor unit of a water heater, and can be widely used as a device that sends air. Also, the air-sending device can be applied to, for example, apparatuses other than outdoor units or facilities.

REFERENCE SIGNS LIST

1 propeller fan, 3 boss, 5 blade, 7 leading edge, 9 trailing edge, 9*a* first trailing edge, 9*b* second trailing edge, 11 outer peripheral edge, 13 inner peripheral edge, 31 direction, 33 flow direction of airflow, 51 outdoor unit body, 51*a* side surface, 51*b* front surface, 51*c* side surface, 51*d* back surface, 51*e* upper surface, 51*f* bottom surface, 51*g* partition plate, 52 front panel, 53 air outlet, 54 fan grille, 56 ventilation compartment, 57 machine compartment, 61 fan motor, 62 rotating shaft, 63 bell mouth, 64 compressor, 65 pipe, 66 substrate box, 67 control substrate, 68 heat exchanger, 70 refrigerant circuit, 72 condenser, 72*a* condenser fan, 73 evaporator, 73*a* evaporator fan, 74 expansion valve.

The invention claimed is:

1. A propeller fan comprising:

a shaft provided on a rotation axis of the propeller fan; and a blade provided on an outer peripheral side of the shaft, wherein the blade has a trailing edge on a rear side of the blade in a rotation direction of the propeller fan, and wherein the trailing edge includes a first trailing edge located on an innermost side of the trailing edge, and a second trailing edge adjacent to and outward of the first trailing edge, wherein where an innermost point of the first trailing edge is a first connection point, a connection point between the first trailing edge and the second trailing edge is a second connection point, a straight line that extends through the rotation axis and the first connection point is a reference line, and an innermost one of points of tangency between the second trailing edge and a tangent line that extends through the first connection point is a first vertex, the second connection point is located forward of the reference line in the rotation direction, or located on the reference line, the second trailing edge is located rearward of the second connection point in the rotation direction, and a length of the first trailing edge is greater than or equal to a length of part of the second trailing edge that is located between the second connection point and the first vertex and wherein the length of the first trailing edge is not more than twice the length of the part of the second trailing edge that is located between the second connection point and the first vertex.

2. The propeller fan of claim 1, wherein the first trailing edge is located forward of the reference line in the rotation direction, or located on the reference line.

3. The propeller fan of claim 1, wherein a radius of a circle whose center is located on the rotation axis and which passes through the second connection point is smaller than half a difference between a radius of a circle whose center is located on the rotation axis and which passes through an outer peripheral edge of the blade and a radius of a circle whose center is located on the rotation axis and which passes through the first connection point.

4. The propeller fan of claim 1, wherein the blade has a leading edge on a front side of the blade in the rotation direction, and wherein where a middle point of an arc that connects an innermost part of the leading edge and an innermost part of the trailing edge and has a constant radius from the rotation axis is a first middle point, and a middle point of an arc that connects the leading edge and the trailing edge, which forms an outer peripheral portion of the blade, has a constant radius from the rotation axis, is a second middle point, the first middle point is located upstream of the second middle point in a direction parallel to the rotation axis.

5. The propeller fan of claim 1, wherein the blade is connected to an outer peripheral portion of the shaft, and wherein where a connection point between the shaft and the leading edge on a forward side of the blade in the rotation direction is a third connection point, the shaft is formed such that a distance between the rotation axis and the first connection point is greater than a distance between the rotation axis and the third connection point.

6. The propeller fan of claim 1, wherein the blade is one of a plurality of blades provided at an outer peripheral portion of the shaft, the propeller fan further comprising a joint that is provided adjacent to the shaft and configured to connect two of the blades that are adjacent to each other in a circumferential direction about the rotation axis.

7. An air-sending device comprising:

the propeller fan of claim 1;

a drive source configured to give a driving force to the propeller fan; and a casing that houses the propeller fan and the drive source.

8. A refrigeration cycle apparatus comprising:

the air-sending device of claim 7; and a refrigerant circuit including a condenser and an evaporator, wherein the air-sending device is configured to send air to at least one of the condenser and the evaporator.

* * * * *